US007530513B2

(12) United States Patent
Tessier et al.

(10) Patent No.: US 7,530,513 B2
(45) **Date of Patent: *May 12, 2009**

(54) APPARATUS AND METHODOLOGY FOR COMMINUTING MATERIALS

(75) Inventors: Lynn Tessier, Eckville (CA); James B. Graham, Cochrane (CA); Russell M. Graham, Calgary (CA)

(73) Assignee: Aerosion, Ltd., Calgary (CA)

( * ) Notice: Subject to any disclaimer, the term of this patent is extended or adjusted under 35 U.S.C. 154(b) by 86 days.

This patent is subject to a terminal disclaimer.

(21) Appl. No.: 11/697,251

(22) Filed: Apr. 5, 2007

(65) Prior Publication Data

US 2007/0241219 A1 Oct. 18, 2007

Related U.S. Application Data

(63) Continuation-in-part of application No. 10/644,654, filed on Aug. 20, 2003, now Pat. No. 7,207,513, and a continuation-in-part of application No. 10/042,052, filed on Oct. 18, 2001, now abandoned.

(60) Provisional application No. 60/480,907, filed on Jun. 23, 2003.

(51) Int. Cl.
*B02C 19/00* (2006.01)

(52) U.S. Cl. ..... 241/275

(58) Field of Classification Search ..... 241/275
See application file for complete search history.

(56) References Cited

U.S. PATENT DOCUMENTS

| | | | | |
|---|---|---|---|---|
| 0,948,129 | A | | 2/1910 | Bilz |
| 2,448,049 | A | | 8/1948 | Rafton |
| 2,507,166 | A | | 5/1950 | Lehman |
| 3,146,958 | A | | 9/1964 | Wallace, Jr. |
| 3,149,790 | A | * | 9/1964 | Hoffstrom ..... 241/55 |
| 3,552,662 | A | | 1/1971 | Grob |
| 3,652,023 | A | * | 3/1972 | Wood ..... 241/275 |
| 3,659,794 | A | | 5/1972 | Hemesath |
| 3,675,373 | A | | 7/1972 | Putnam |
| 3,688,991 | A | | 9/1972 | Andrews |
| 3,815,833 | A | | 6/1974 | Vliet et al. |
| 3,973,733 | A | | 8/1976 | Switzer |
| 3,982,702 | A | | 9/1976 | Barnhart et al. |
| 4,061,279 | A | | 12/1977 | Sautter |
| 4,126,280 | A | | 11/1978 | Burk |

(Continued)

FOREIGN PATENT DOCUMENTS

| | | |
|---|---|---|
| DE | 576895 | 5/1933 |

(Continued)

*Primary Examiner*—Mark Rosenbaum
(74) *Attorney, Agent, or Firm*—Sean W. Goodwin

(57) ABSTRACT

A comminuting apparatus has a coaxial throwing wheel and impact rotor, the throwing wheel preferably comprising a plurality of channels for conducting particles from a central axis inlet to a plurality of particle exits to impact the impact rotor. The throwing wheel can be an assembly of wear-resistant inserts forming the channels. Flow channels through the throwing wheel can be configured, such as converging towards the particle exits to minimize energy loss during acceleration of the particles. Further, the comminuting apparatus can include a housing for ready access to the throwing wheel and impact rotor. A two-part housing is reversibly separable for accessing the comminuting chamber, throwing wheel and impact rotor within.

19 Claims, 20 Drawing Sheets

U.S. PATENT DOCUMENTS

| | | | | | |
|---|---|---|---|---|---|
| 4,280,665 | A | | 7/1981 | Addams, III et al. | |
| 4,504,017 | A | | 3/1985 | Andrews | |
| 4,646,483 | A | * | 3/1987 | Mangan | 451/97 |
| 4,690,341 | A | | 9/1987 | Hise et al. | |
| 4,892,261 | A | | 1/1990 | Rolle et al. | |
| 5,029,761 | A | * | 7/1991 | Bechler | 241/275 |
| 5,248,101 | A | | 9/1993 | Rose et al. | |
| 5,513,811 | A | | 5/1996 | Phan Hung | |
| 5,769,693 | A | | 6/1998 | Wadephul | |
| 5,836,369 | A | | 11/1998 | Renner et al. | |
| 6,092,749 | A | | 7/2000 | Stegmeier | |
| 6,227,472 | B1 | | 5/2001 | Ryan et al. | |
| 6,802,466 | B1 | * | 10/2004 | Van Der Zanden | 241/275 |
| 7,207,513 | B2 | * | 4/2007 | Tessier et al. | 241/275 |

FOREIGN PATENT DOCUMENTS

| | | | |
|---|---|---|---|
| DE | 1149229 | | 5/1933 |
| FR | 2538718 | | 7/1984 |
| WO | WO 96/032196 | A1 | 10/1996 |
| WO | WO 03/033157 | A1 | 4/2003 |
| WO | WO 2004/112963 | A2 | 12/2004 |
| WO | WO 2004/112963 | A3 | 12/2004 |

* cited by examiner

APPARATUS AND METHODOLOGY FOR COMMINUTING MATERIALS

CROSS REFERENCE TO RELATED APPLICATIONS

This application is a Continuation-In-Part of the commonly owned U.S. patent application Ser. No. 10/644,654, filed Aug. 20, 2003, presently pending, which is hereby incorporated by reference in its entirety and which claims priority from commonly owned U.S. Provisional Patent Application No. 60/480,907, filed 23 Jun. 2003 which is hereby incorporated by reference in its entirety. Application Ser. No. 10/644,654 is also a Continuation-In-Part of the commonly owned U.S. patent application Ser. No. 10/042,052, filed 18 Oct. 2001, now abandoned, which is hereby incorporated by reference in its entirety.

BACKGROUND OF THE INVENTION

Many different types of material are comminuted for reducing the size of the particulates forms of the material. For example, coal excavated from a mine is frequently comminuted to make the particulate size smaller and more uniform to facilitate the coal's transportion and/or to provide consistent combustion in a furnace. In another example, food stuffs, such as wheat, are frequently comminuted to produce flour. Rock containing a desirable ore is frequently comminuted to provide easier access to the ore and the metal included in the ore.

A common way of comminuting material is to collide a particle of the material with an impact surface. The collision generates a force on and inside the particle that causes the particle to fracture into two or more smaller pieces. The amount of force generated in the collision is directly proportional to the impact speed of the particle. The impact speed of the particle is relative to the impact surface at the moment of collision. The generated force increases as the impact speed increases. As the force applied to the particle increases, the size of the pieces that result from the collision of the particle with the impact surface decreases.

There are many different comminuting devices that collide a particle of material with an impact surface. For example, hammer mills comminute particles of material with a rotating set of hammers having impact surfaces. In operation, the material is dropped into the mill and fed by gravity to the hammers. The hammers smash the particles of the material into smaller pieces and also throw some of the particles and pieces against a side of the mill. In a hammer mill the impact speed of the particles largely depends on the rotational speed of the hammers.

Another type of comminuting device is a pin mill. The pin mill comminutes particles of material with multiple rings of pins spinning in opposite directions. In operation, the material is dropped into the center of the mill and moves outwardly through the paths of the pins in each ring. As the particles of material move, the pins knock the particles. In a pin mill, the impact speed of the particles largely depends on the speed of the pins moving along the paths.

Another type of comminuting device is a jet mill. Jet mills comminute particles by accelerating the particles with a jet of air and directing the accelerated particles against an impact surface, which may or may not be stationary, or against an opposing jet of particles. In operation, a jet of air is generated and the particle is then fed into the jet to accelerate it. Once accelerated to a desired speed, the particle is directed toward and collides with the impact surface or another particle of an opposing jet. In a jet mill, when the impact surface is stationary, the impact speed of a particle largely depends on the speed of the particle, and when the impact surface moves, or an opposing jet of particles is used, the impact speed of a particle largely depends on the combined speed of the particle and the impact surface or particle of the opposing jet.

The aforementioned comminuting devices are energy intensive which can be related to a given particulate size. Hammer mills and pin mills typically generate a maximum impact speed of about 350 ft/sec and about 550 ft/sec respectively. A significant reduction in a material's particulate size typically requires the material to be run through these mills more than once. Thus, the amount of energy consumed during the comminuting process includes the amount of energy required to operate these mills during multiple runs. Furthermore, to generate impact speeds greater than about 550 ft/sec, the hammers and pins would have to rotate/move faster than their conventional structures will allow without sustaining substantial wear or catastrophic failure. Although jet mills can generate higher impact speeds than hammer and pin mills, the amount of energy jet mills consume can also be significant because they generate a jet of air to accelerate a particle, which typically requires a substantial amount of energy.

As shown in French patent application published as FR 2538718A1 to Vannier, another type of device is the centrifugal throwing wheel for accelerating particles from a central axis and through radially extending slots formed in the wheel for impacting the accelerated particles against a spaced peripheral target. In 1933, German Patent DE 576895 to Meffert, the target is a ribbed funnel ring counter-rotating with respect to the rotating throwing wheel.

The known throwing wheels can suffer from inefficiencies in moving the particle to the wheel's periphery. The harsh environment results in rapid erosion of components and as a result, and inherent in the dynamics of comminuting apparatus, imposes great challenges in maintaining integrity of the components and in driving and rotationally supporting such components. Erosion of components is inevitable and ease of access to the throwing wheel and related equipment is desirable.

SUMMARY OF THE INVENTION

In embodiments of the invention, an improved comminuting apparatus comprises a throwing wheel having improved construction and material flow characteristics. An improved wheel enables use of particularly wear-resistant components only where required. Generally radially extending flow channels through the throwing wheel can be configured to minimize energy loss for maximum acceleration of the materials. The channels can converge towards the particle exits for minimizing eddies and the like.

Further, in other embodiments, the comminuting apparatus further comprises a housing which is readily accessible for maintenance. The housing comprises a two-part housing which is reversibly separable for accessing the comminuting chamber, throwing wheel and impact rotor within.

In one broad aspect, a throwing wheel for accelerating and discharging particles for impact against impact surfaces of a particle fragmenting device comprises: a body having a central inlet port along an axis of the body and a periphery having a plurality of particle exits, the port being adapted for receiving particles; and a plurality of channels within the body extending generally radially from the central inlet port to the plurality of particle exits, each channel having a top wall, a bottom wall, and side walls, wherein the side walls of each channel preferably converge towards the particle exits at the periphery. Preferably the body can comprises an assembly of replaceable generally pie-shaped inserts for forming the channels sandwiched between a top and a bottom plate. The inserts can be supported by bosses extending from one of the top of bottom plates and into cavities in the inserts.

In another aspect, a fragmenting apparatus comprises the throwing wheel coupled with an impact wheel. More preferably, the throwing wheel and impact rotor are operable within a housing. The housing can comprise an upper housing for rotatably supporting one of the throwing wheel or impact rotor; and a lower housing for rotatably supporting the other of one of the impact rotor or throwing wheel, the upper and lower housings being separable at about the throwing wheel for access to the throwing wheel and impact rotor. Preferably the upper housing is supported and the lower housing can be actuated between a closed position wherein the throwing wheel and impact rotor are axially coupled for aligning the particle trajectory with the impact surface, and an open position wherein the throwing wheel and impact rotor are axially decoupled for access to each throwing wheel and impact rotor in dependently.

The above apparatus enables practicing a methodology for fragmenting particles comprising: rotating a throwing body about a substantially vertical axis, the throwing body having a central inlet at a top of the body at the axis and a plurality of channels within the body and extending generally radially from the central inlet port for forming a plurality of flow paths to a plurality of particle exits at a periphery of the body, each channel having a top wall, a bottom wall, and side walls; introducing particles to be fragmented through the central inlet for accelerating the particles through the channels; converging the flow path as the particles flow from the central inlet to the particle exits for favoring streamline flow of particles between the side walls; discharging the particles from the particle exits; and impacting the discharging particles against impact surfaces arranged about the periphery of the throwing body. Preferably, the impacting of the discharging particles against impact surfaces further comprises rotating an impact rotor co-axially with the throwing body, the impact rotor supporting a plurality of impact surfaces arranged concentrically about the periphery of the throwing body thereon and wherein the impact rotor is counter-rotated relative to the throwing body.

BRIEF DESCRIPTION OF THE DRAWINGS

From Co-pending Application Ser. No. 10/644,654.

Figure 10:
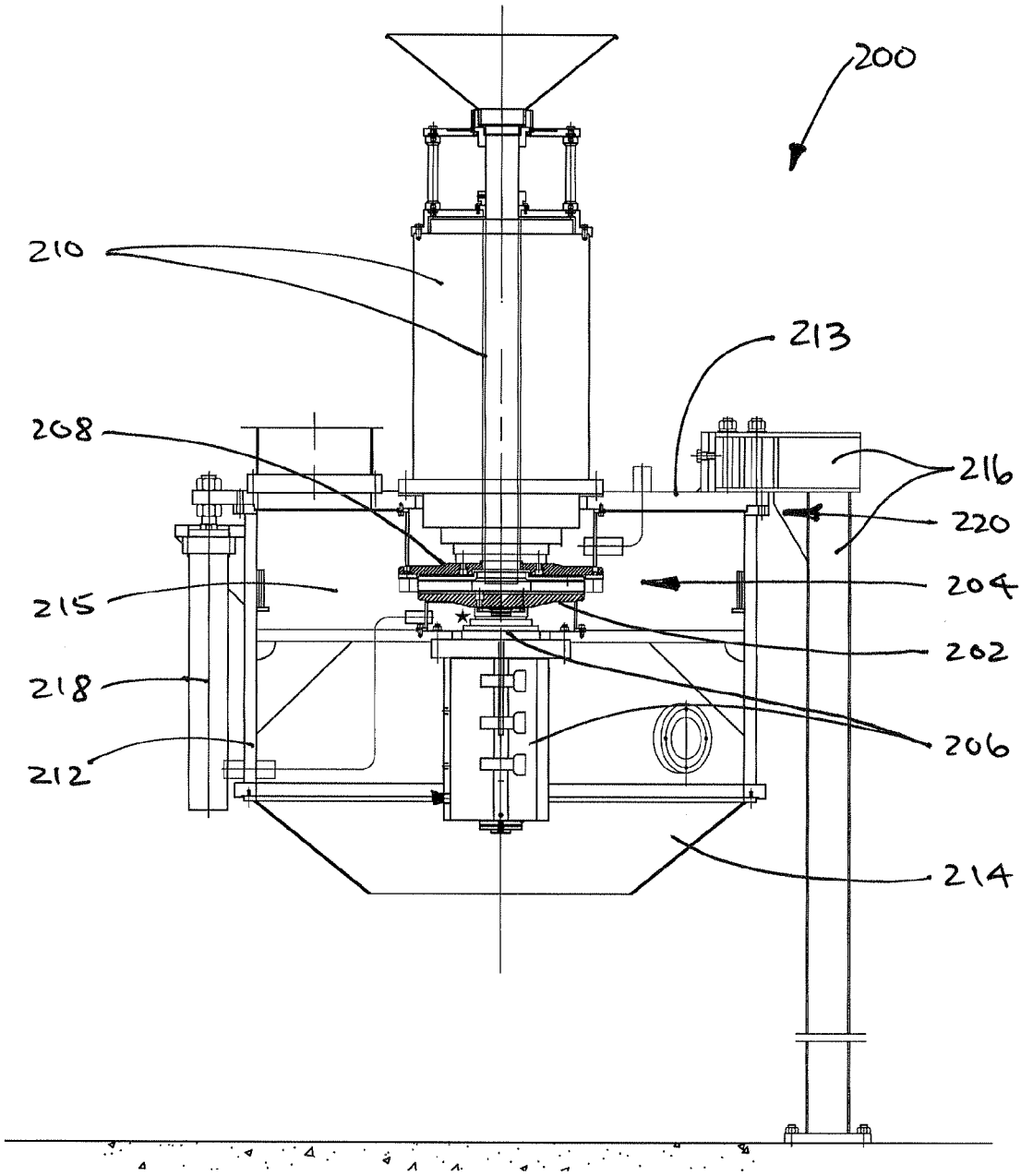
Figure 11:
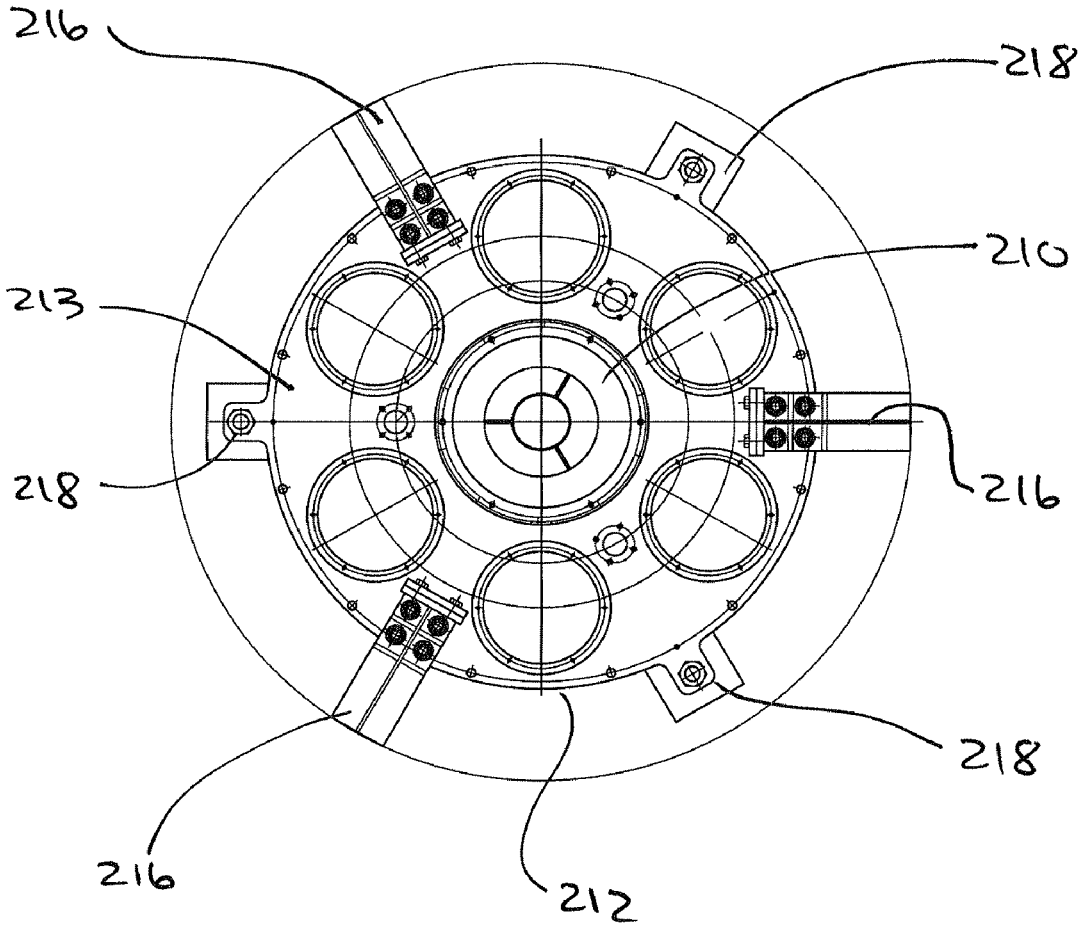
Figure 12:
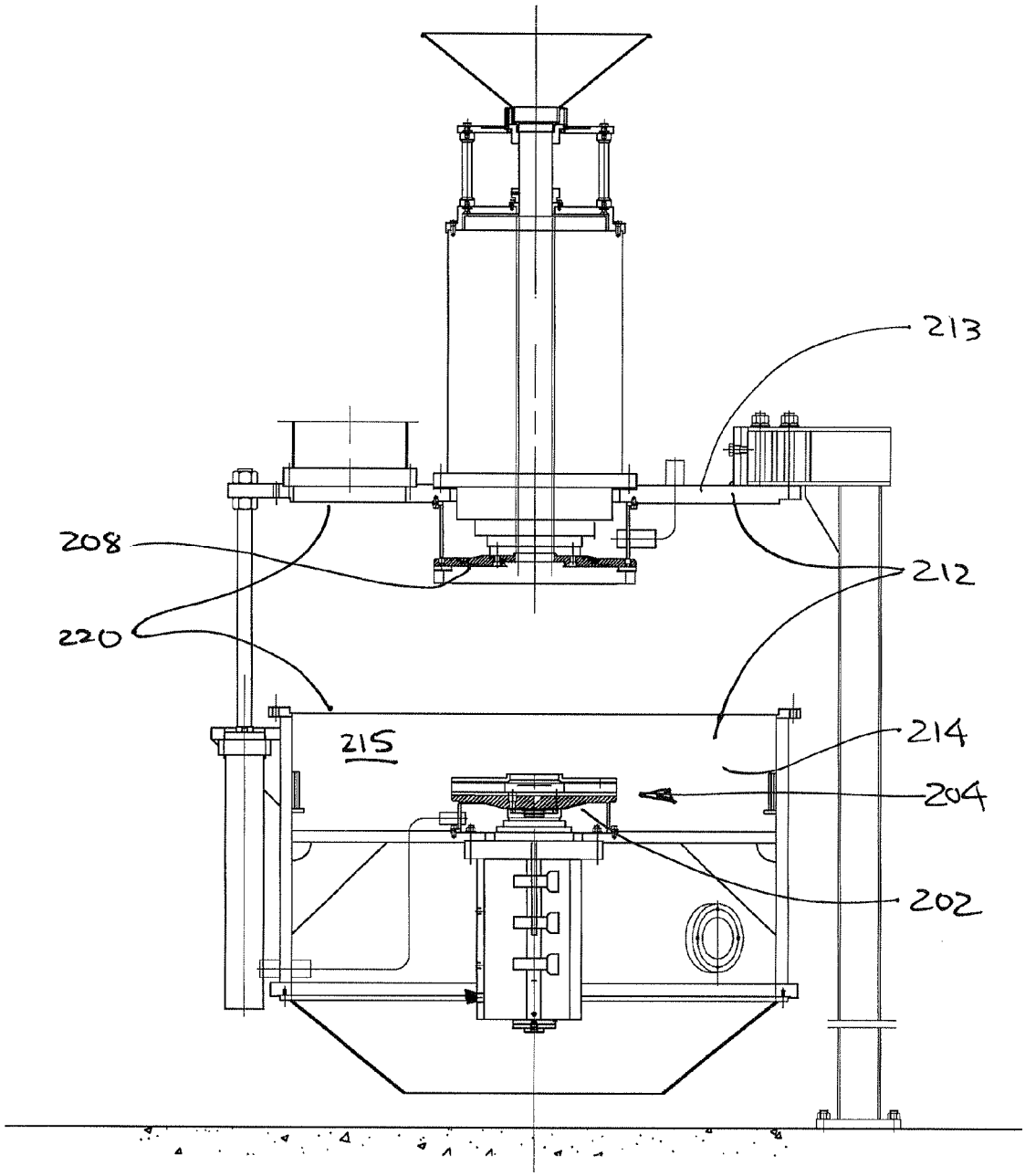
Figure 13:
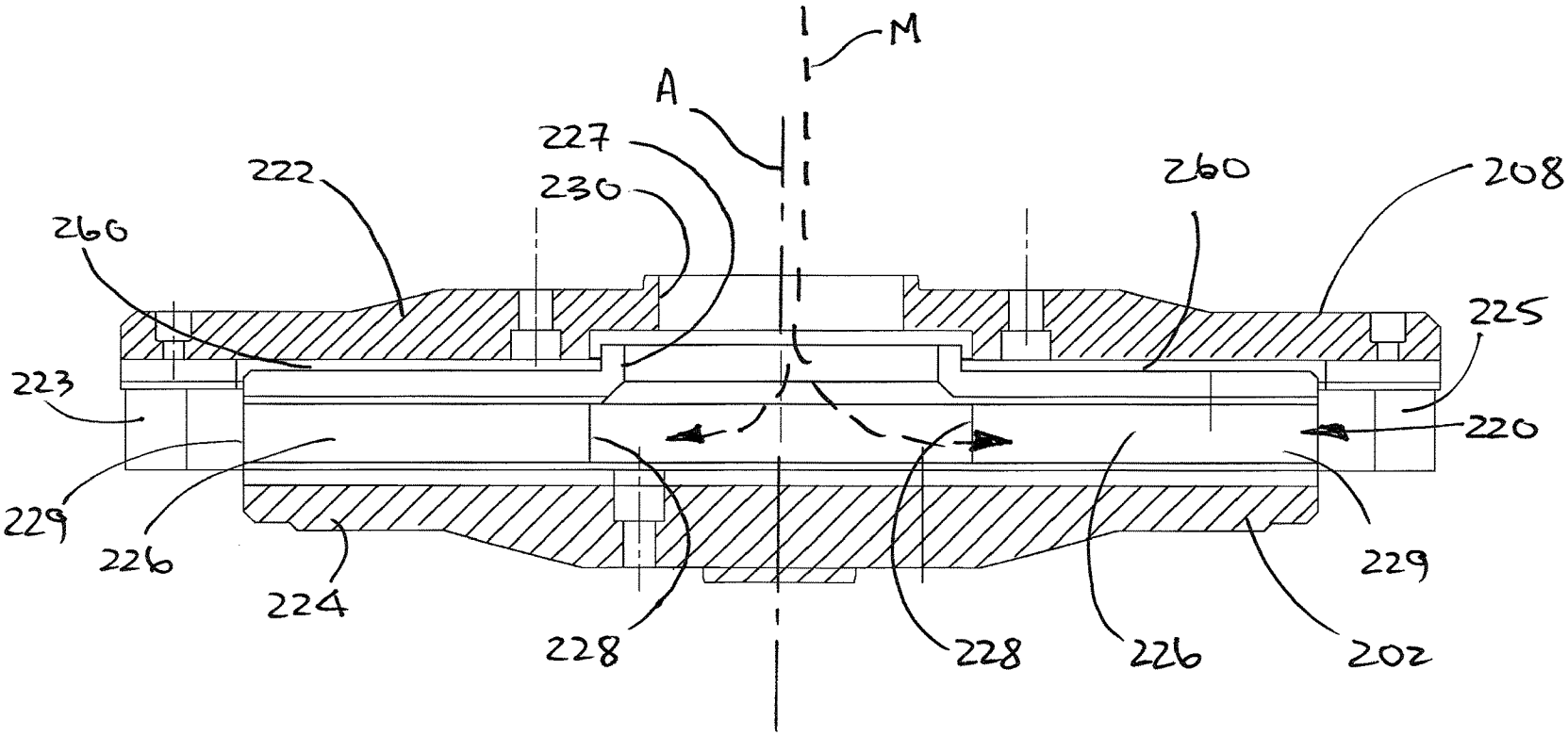
Figure 14A:
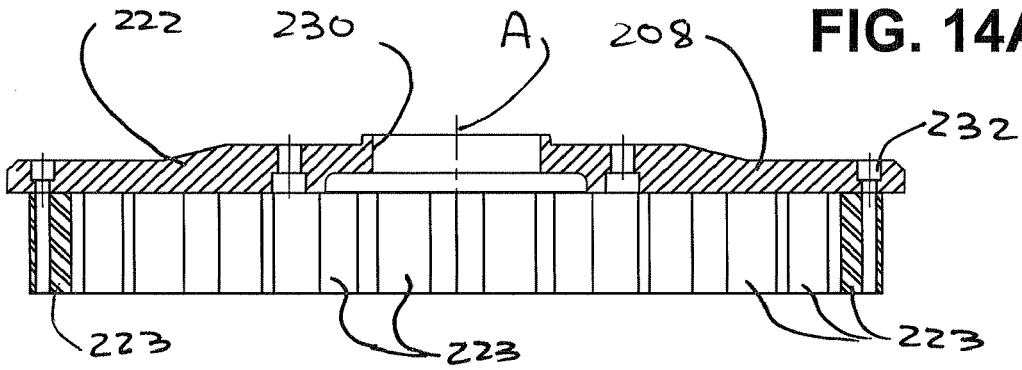
Figure 14B:
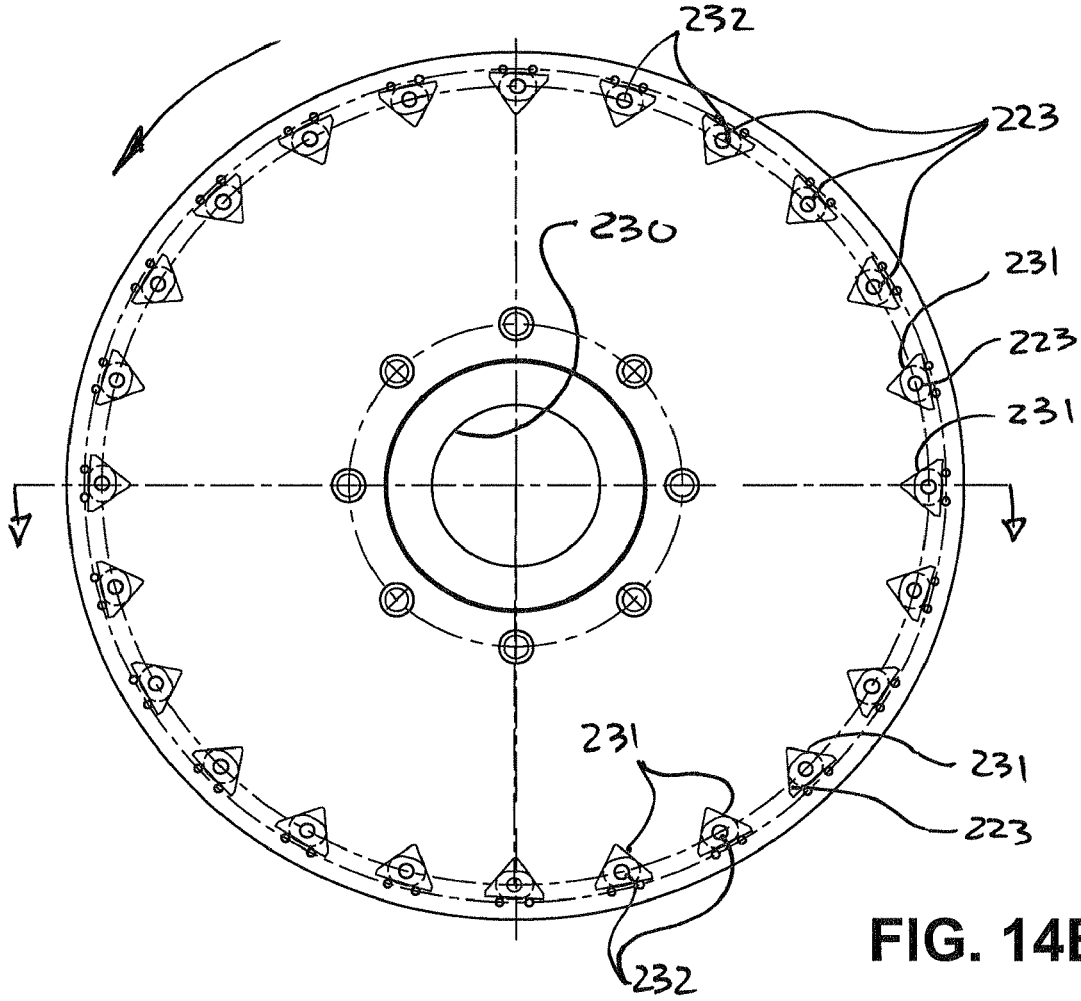
Figure 15A:
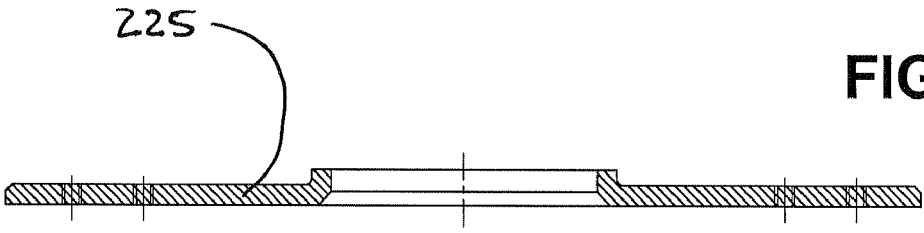
Figure 15B:
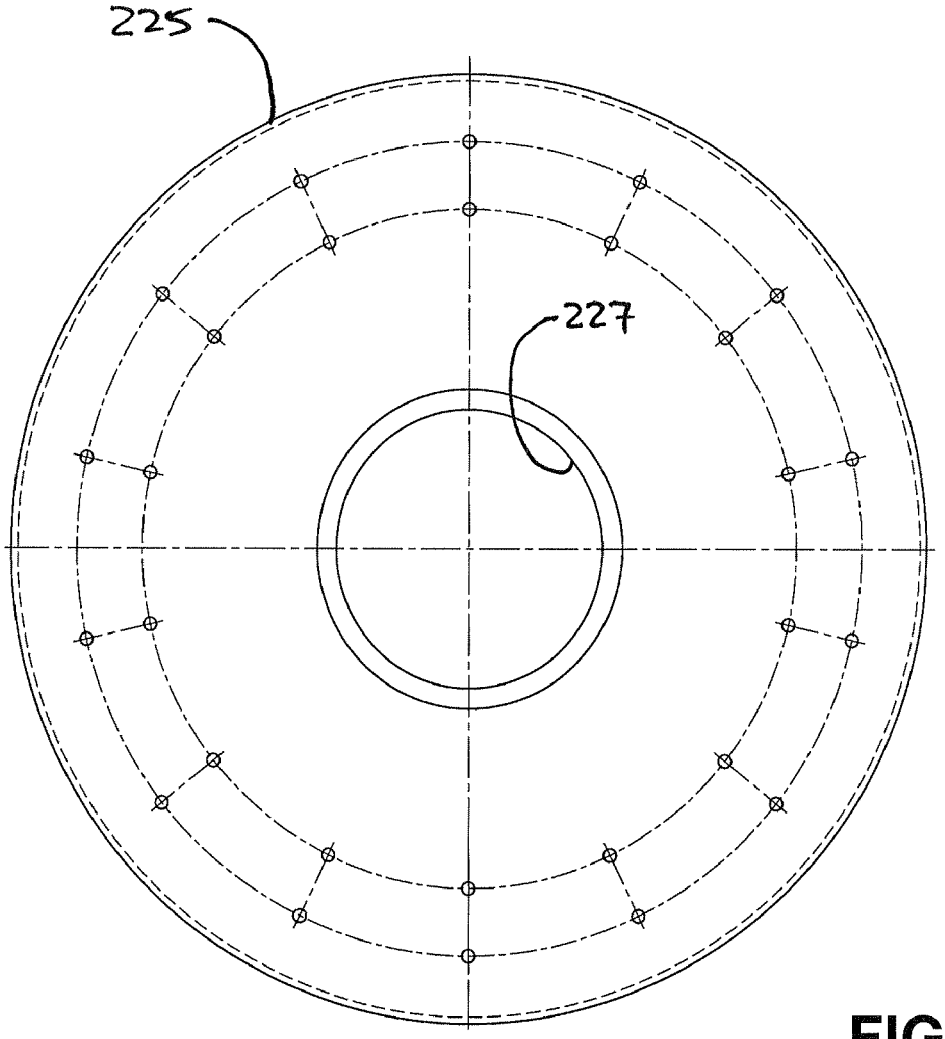
Figure 15C:
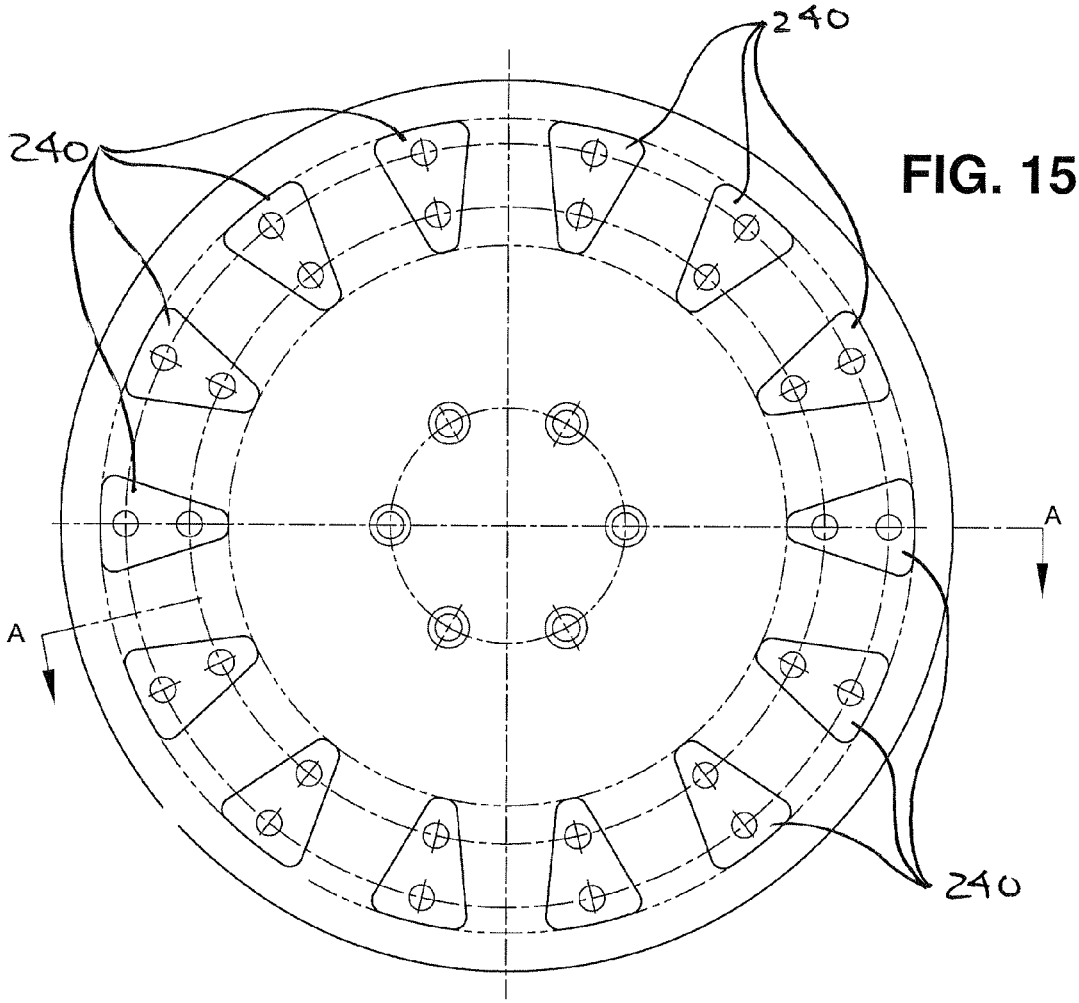
Figure 15D:
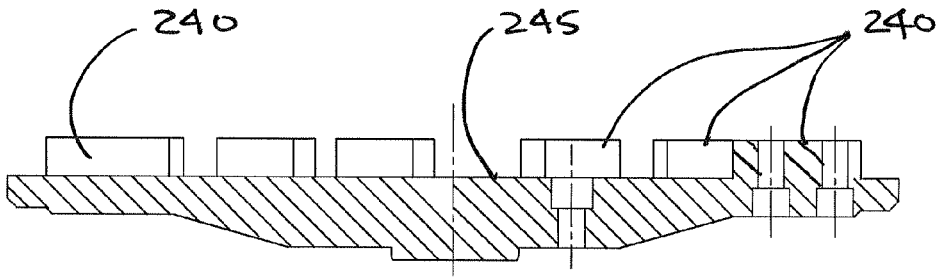
Figure 15E:
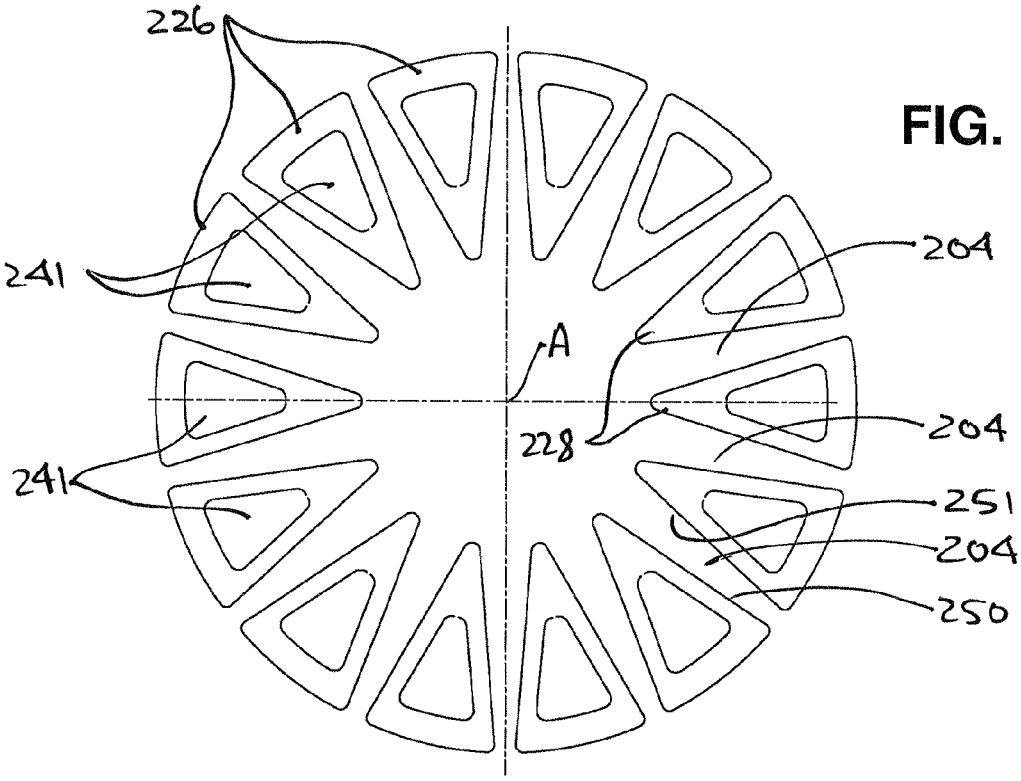
Figure 15F:
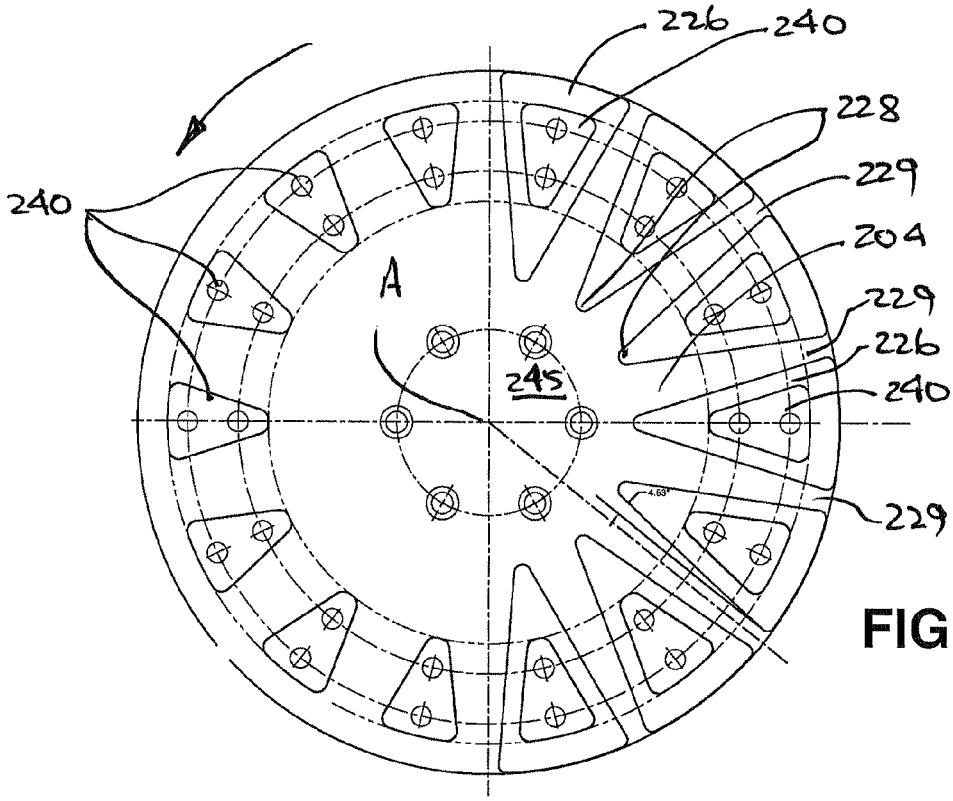
Figure 16:
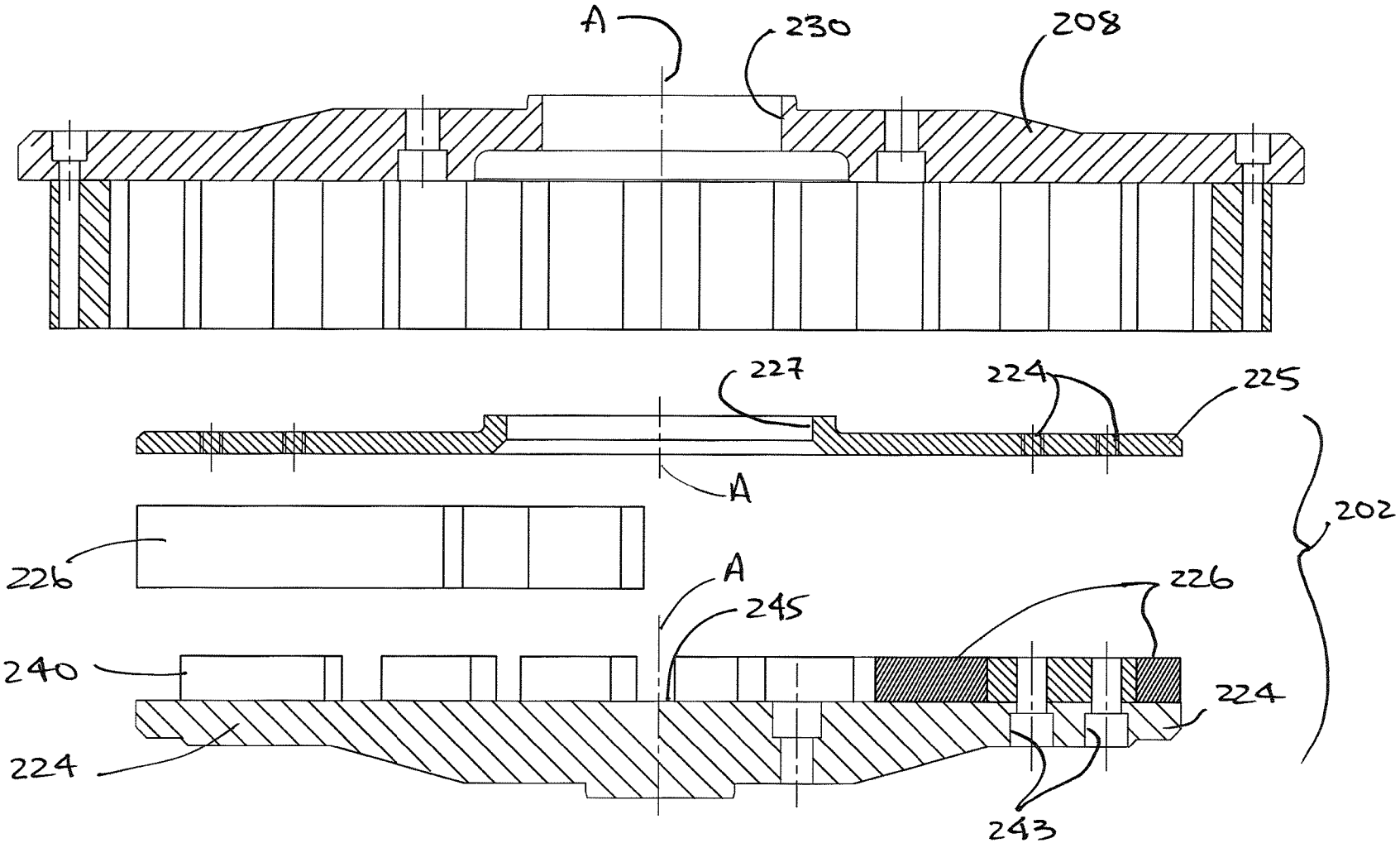
Figure 17:
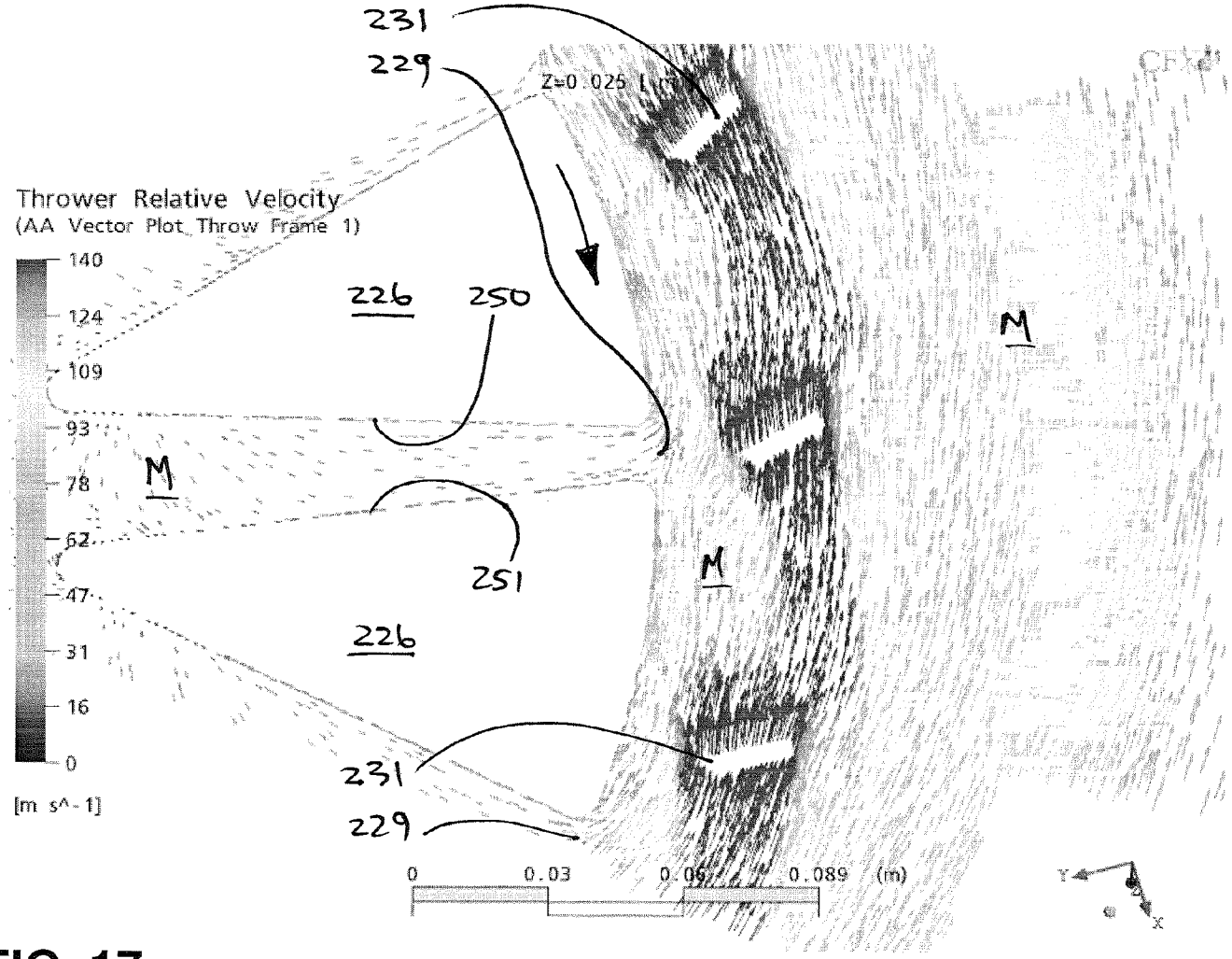
Figure 18:
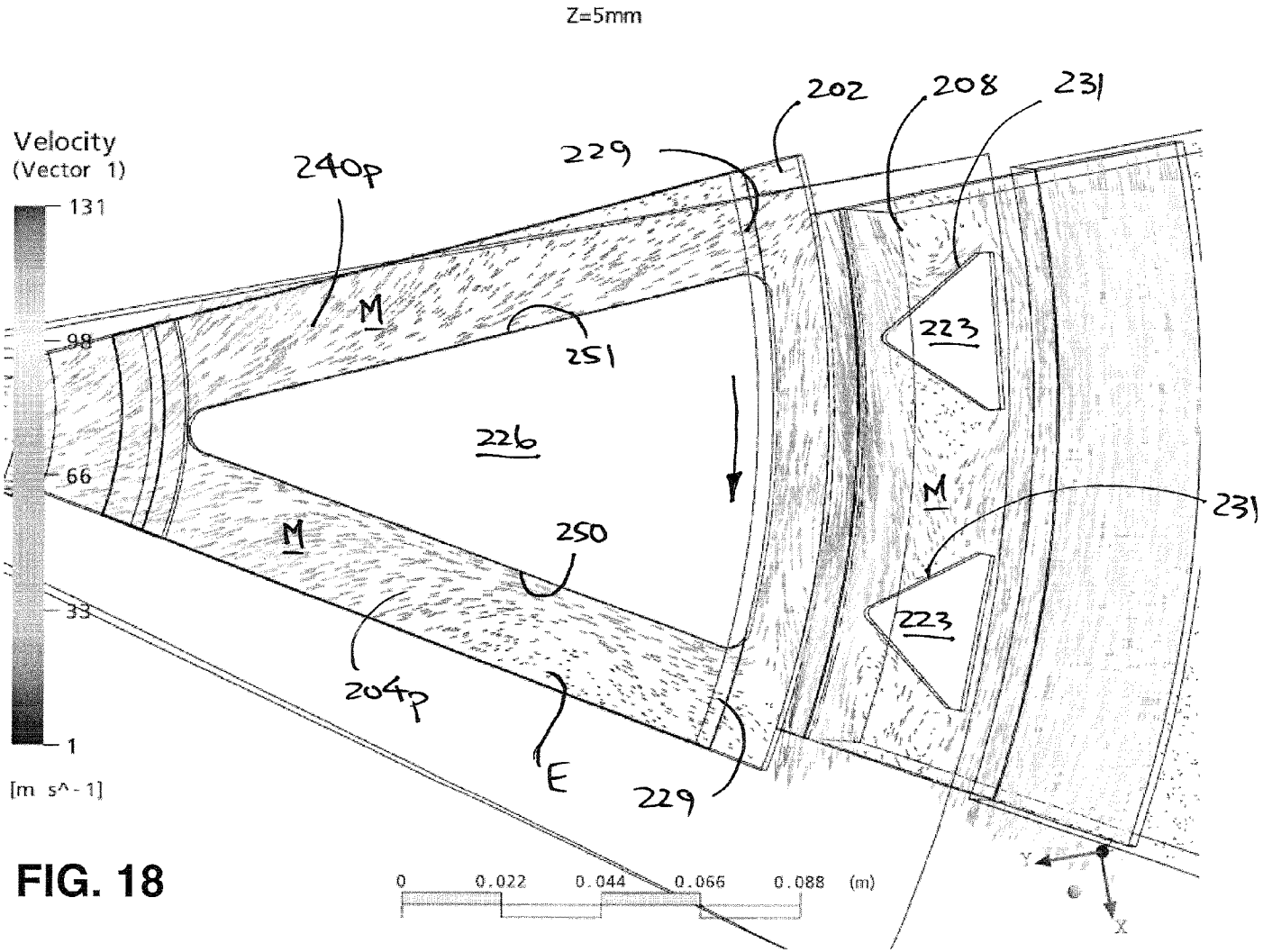
Figure 19:
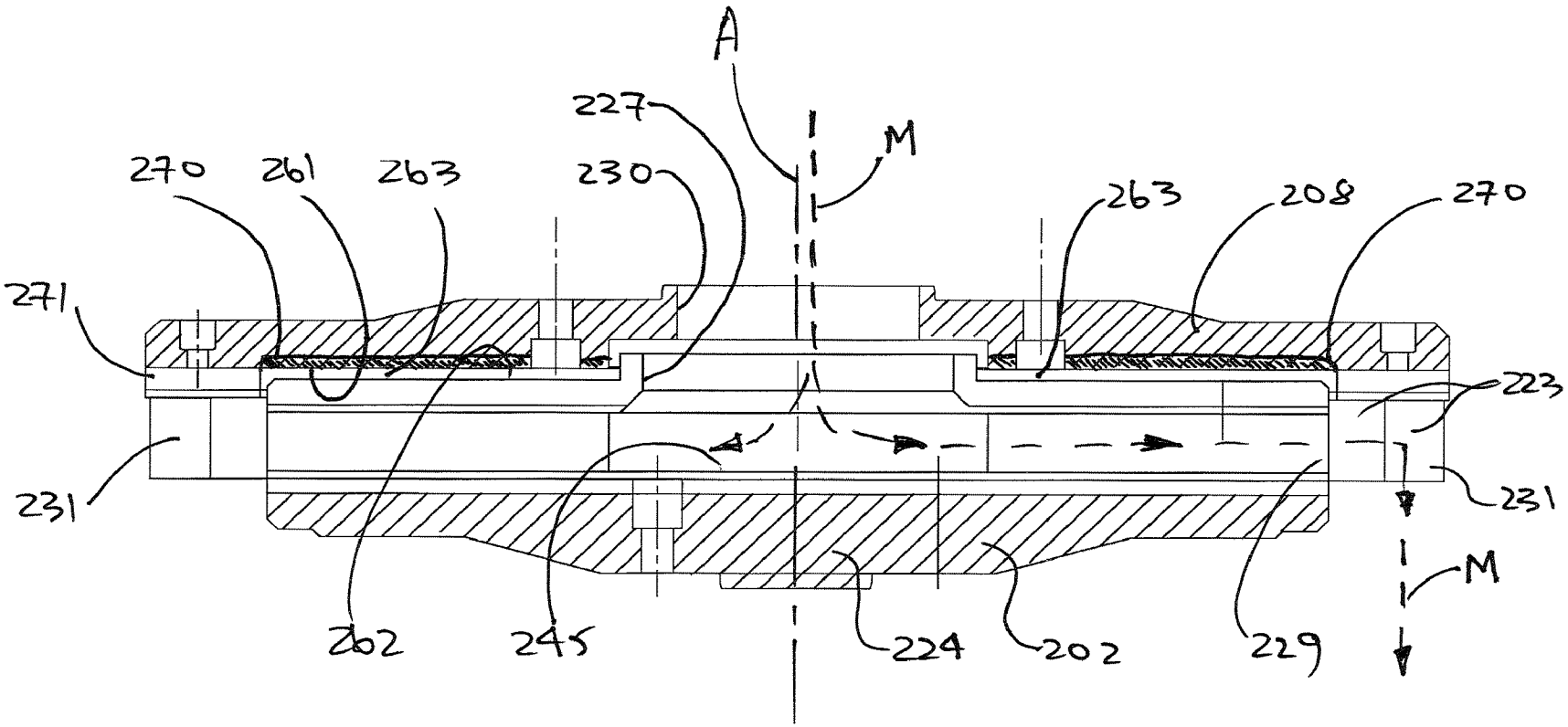
Figure 20:
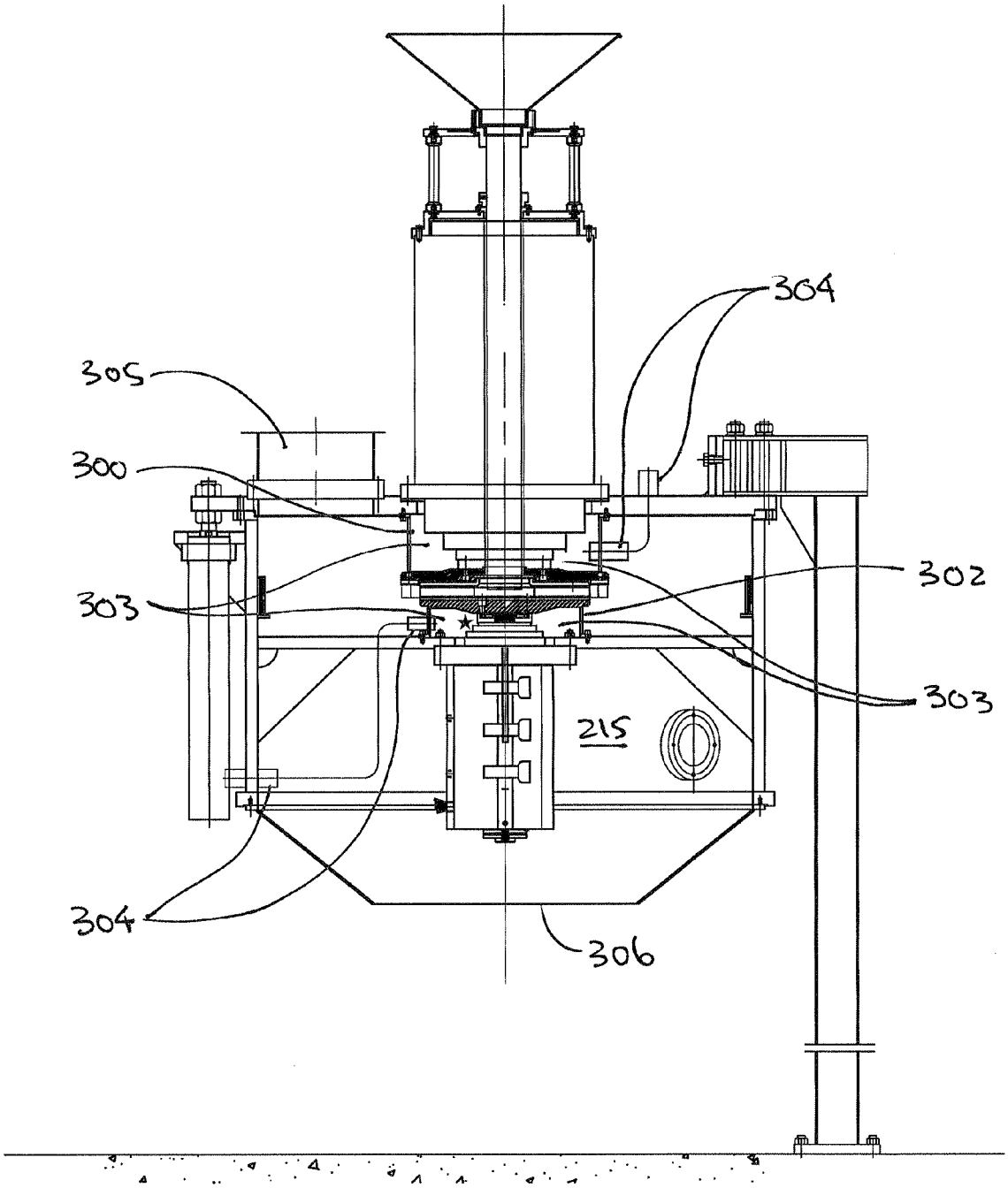

Further Embodiments:

FIG. 10 is a cross-sectional view of a comminuting device or apparatus according another embodiment of the invention;

FIG. 11 is a top view of the comminuting device according to FIG. 10;

FIG. 12 is a cross-sectional view of the comminuting device of FIG. 10 illustrated in an open state for accessing the throwing wheel and impact rotor according an embodiment of the invention;

FIG. 13 is a side cross-sectional view of an embodiment of a throwing wheel axially coupled with an embodiment of an impact rotor;

FIGS. 14A and 14B are side cross-sectional and underside views of an embodiment of the impact rotor of FIG. 13;

FIGS. 15A through 16 illustrate an embodiment of the throwing wheel of FIG. 13. More particularly, FIGS. 15A and 15B are side cross-sectional and underside views respectively of a top plate for an embodiment of the throwing wheel;

FIGS. 15C and 15D are top and side cross-sectional views respectively of the structure of a bottom plate for the throwing wheel;

FIG. 15E illustrates a top view of the plurality of elements for installation to the bottom plate of FIG. 15F for the throwing wheel of FIG. 13;

FIG. 15F illustrates a top view of the bottom plate of FIG. 13, with ½ of the plurality of elements of FIG. 15E for installation to the rightmost illustrated bosses;

FIG. 16 is a side cross-sectional view of the impact rotor poised axially over a partially exploded view of the throwing wheel comprising the top plate, the leftmost one half of the elements shown before installation to the bottom plate, and the rightmost one half of the elements installed to the bottom plate;

FIG. 17 illustrates particle velocity results of Computational Fluid Dynamics (CFD) analysis illustrating the effect of a narrowing channel between elements of the throwing wheel according to one embodiment of the invention;

FIG. 18 illustrates particle velocity results of CFD analysis illustrating the effect of a parallel channel between elements of the throwing wheel according to another embodiment of the invention;

FIG. 19 is a side cross-sectional view of the throwing wheel of FIG. 13; and FIG. 20 is a cross-sectional view of a comminuting device according to FIG. 10.

DETAILED DESCRIPTION OF THE PREFERRED EMBODIMENTS

Generally

Figure 1:
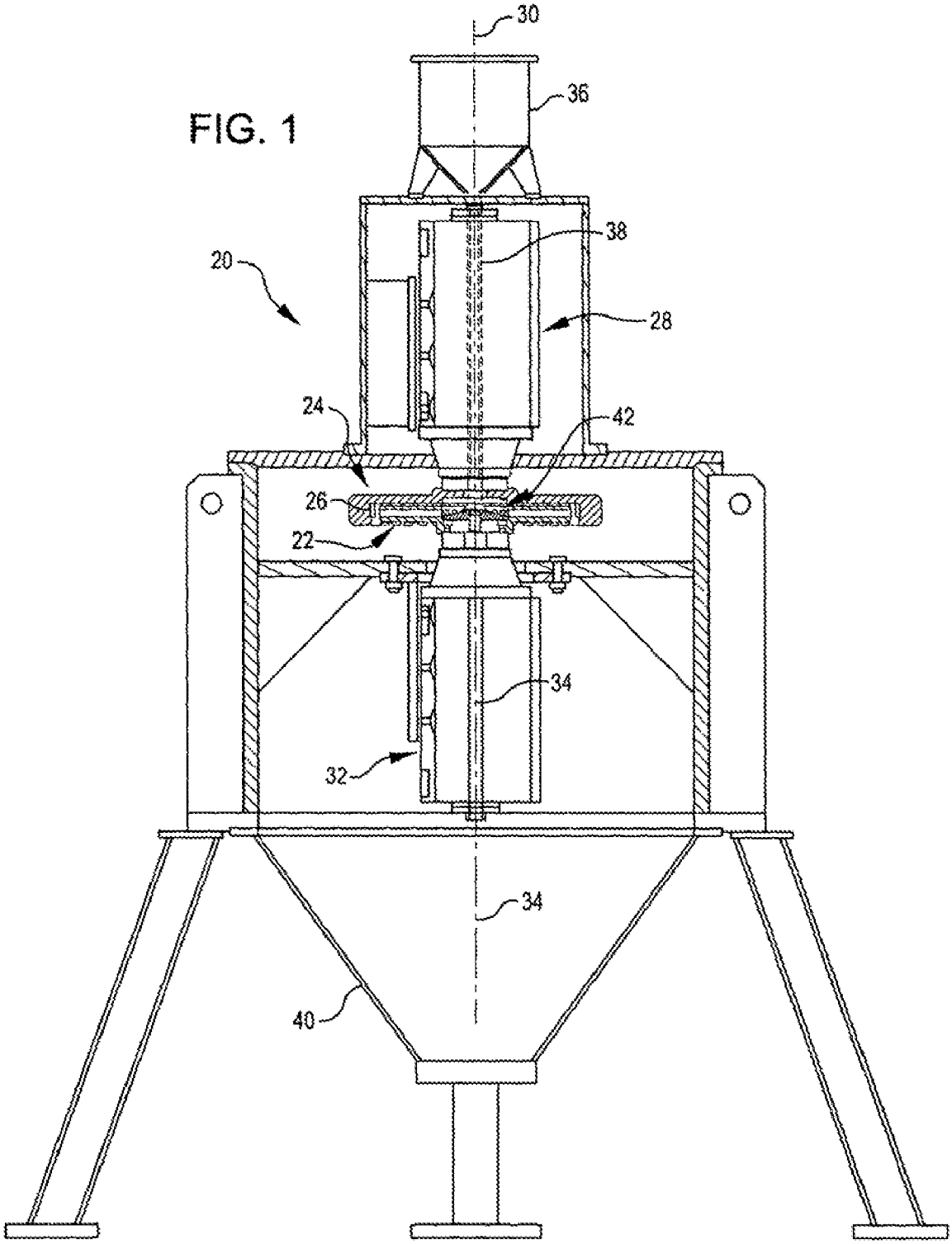
FIG. 1 is a partial cross-sectional view of a comminuting device according to an embodiment of the invention, more particularly as disclosed in Applicant's co-pending application Ser. No. 10/644,654 and published as US 2004-0113002 A1 on Jun. 17, 2004.

FIG. 1 is a partial cross-sectional view of a comminuting device 20 according to a first embodiment of the invention. This embodiment and exemplary variations therefrom and shown in FIGS. 2-9 are detailed in co-pending application Ser. No. 10/644,654, filed Aug. 20, 2004, now published as US 2004-0113002 A1, the entirety of which is incorporated herein by reference. FIGS. 1-9 and portions of the specification of Ser. No. 10/644,654 are reproduced herein to assist the reader.

As shown in FIG. 1, the comminuting device 20 includes a throwing wheel 22 to accelerate particles of material (omitted for clarity of the apparatus) toward an impact speed, and toward an impact rotor 24 that includes an impact surface 26 (see also FIG. 3) to fragment particles that collide with the impact surface 26 after exiting the throwing wheel 22. The comminuting device 20 also includes an impact motor 28 to rotate the impact rotor 24 about a rotor axis 30 and a throwing motor 32 to rotate the throwing wheel 22 about a wheel axis 34 in a direction opposite to the rotation of the impact rotor 24. In addition, the comminuting device 20 includes an inlet hopper 36 to receive particles of material, a conduit 38 to direct the particles of material from the hopper 36 to the throwing wheel 22, and an outlet hopper 40 to collect processed material.

By rotating the throwing wheel 22 and the impact rotor 208 in opposite directions, the impact speed of the particles become a combination of the particles' speed and the impact surface's speed. If, at the moment of collision, the trajectory of the particle is aligned but opposite in direction to the trajectory of the impact surface 26, then the particle's impact speed will be the sum of the particle's speed and the impact surface's speed. Thus, the comminuting device 20 can generate impact speeds exceeding those generated by conventional comminuting devices. This increase in impact speed combined with an orientation of the impact surface 26 that aligns the direction of the impact surface 26 with the trajectory of the particles increases the force generated on and in the particles at the moment of collision. Consequently, particles of the material may be fragmented into smaller pieces after one run through the comminuting device 20, which allows the comminuting device 20 to comminute material more efficiently.

Figure 2A:
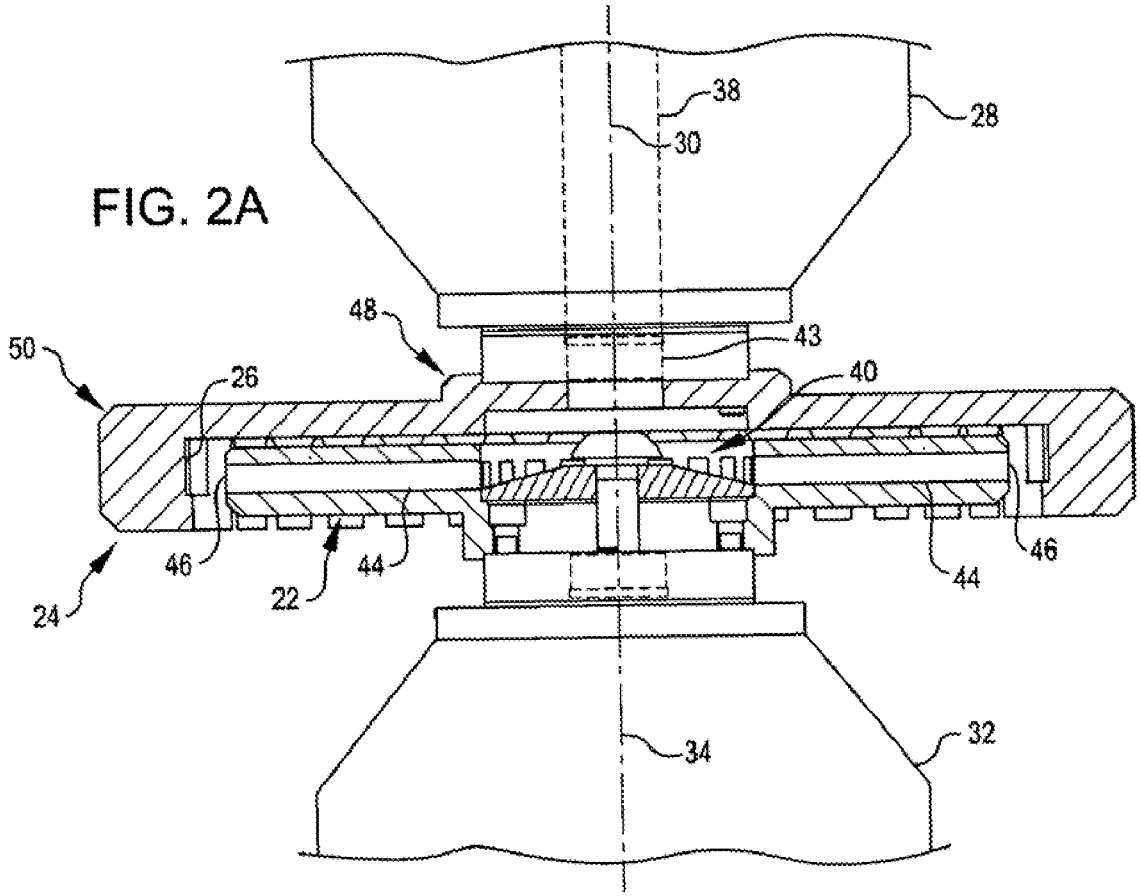
FIG. 2A is a larger view of the cross-sectional view in FIG. 1 of a throwing wheel and impact rotor incorporated in the comminuting device, according Applicant's co-pending application Ser. No. 10/644,654.
Figure 2B:
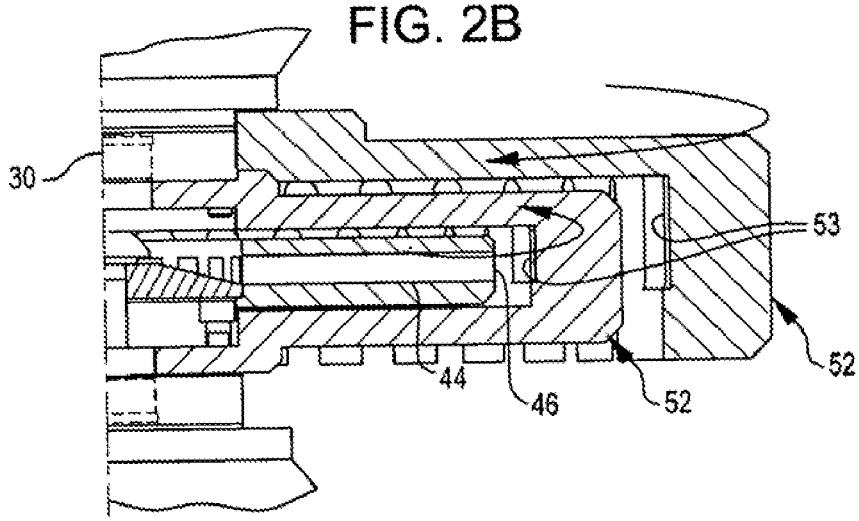
FIG. 2B is a cross-sectional view of a comminuting device according Applicant's co-pending application Ser. No. 10/644,654 that incorporates a throwing wheel and two impact rotors.

As shown in FIGS. 1, 2A and 2B, the comminuting device 20 uses tangential and centrifugal force to accelerate particles of material toward an impact speed. FIG. 2A is a larger view of the cross-sectional view in FIG. 1 of the throwing wheel 22 and the impact rotor 24 incorporated in the comminuting device 20.

First, material is poured in the hopper 36 and flows through the conduit 38 to a hub 42 of the throwing wheel 22. The conduit 38 may include a valve (not shown) to allow one to control the flow rate of the material to the throwing wheel 22. Once particles enter the hub 42, the rotation of the throwing wheel 22 exerts a tangential force on the particles and generates centrifugal force in each particle that propels each particle radially away from the hub 42 toward an exit of the throwing wheel 22. As each particle moves away from the hub 42, the tangential and centrifugal forces accelerate the particles toward an impact speed. Upon exiting the throwing wheel 22, each particle continues to move on a trajectory and then collides with an impact surface 26 of the impact rotor 24 that is moving toward the particles. After colliding with the impact surface 26, the particles and/or fragments of the particles may collide with other portions of the impact rotor 24 and/or throwing wheel 22 eventually fall downward into the hopper 40.

The throwing wheel 22 and the impact rotor 24 are mounted in the comminuting device 20 such that the wheel axis 34 and the rotor axis 30 are aligned or substantially aligned. The throwing wheel 22 is mounted to the throwing motor 32, and the impact rotor 24 is mounted to the impact motor 28. The motors 32 and 28, for example electric motors, are designed to power their respective throwing wheel 22 and impact rotor 24 at a desired rotational speed for a given material flow rate through the comminuting device 20.

With reference to FIG. 2A, in one embodiment, the hub 42 of the throwing wheel 22 receives particles of material through a central port hole 43 in the impact rotor 24 via the conduit 38. The throwing wheel 22 comprises a plurality of channels 44 to direct the particles of material from the hub 42 toward a periphery of the wheel 22. The particles accelerate toward an impact speed and exit through wheel exits 46. The use of centrifugal force to accelerate each particle toward an impact speed is less than the amount of energy frequently required by conventional comminuting devices.

As shown in FIGS. 1 and 5-7B, the impact rotor 24 comprises a rotor hub 48 having hole 43 that allows the particles of material to enter the throwing wheel's hub 42 from the conduit 38. Further, impact rotor 24 includes an impact surface 26 about a rotor periphery 50. When the impact rotor 24 rotates about the rotor axis 30, the impact surface 26 revolves around the throwing wheel 22 in a concentric and contra-rotating circular path. Thus, after a particle leaves the throwing wheel 22 through the exit 46, the particle and the impact surface 26 collide to fragment the particle into smaller pieces.

The throwing wheel 22 accelerates particles of material toward an impact speed and throws the particles from an exit 46 on a trajectory away from the wheel 22. To increase the impact speed of the particle, the throwing wheel 22 is designed to throw the particles on a trajectory that is aligned with or is as closely aligned as possible with the direction of the impact surface 26 (FIGS. 1 and 2) at the moment of collision.

When a particle leaves the throwing wheel 22 through an exit 46, the trajectory of the particle includes a first directional component that is tangent to the periphery 54 and at least a second directional component that is radial to the hub 42. The magnitude of each of these directional components depends on the velocity and acceleration of the particle as the particle leaves the wheel 22. By modifying the direction of each channel 44 as they extend toward the periphery 54, and the angle that each channel 44 intersects the periphery 54, one can modify the two directional components of the particle's trajectory.

Figure 3:
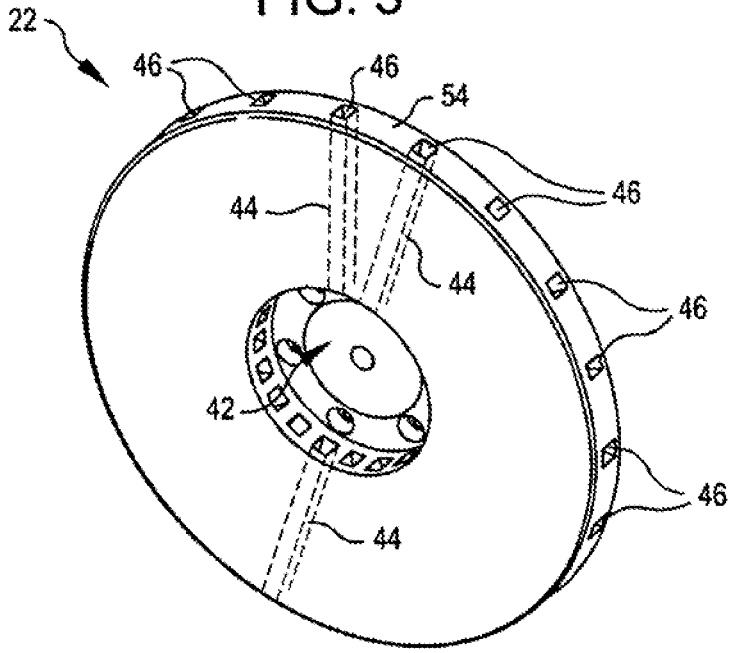
FIG. 3 is a perspective view of the throwing wheel in FIGS. 1, 2A and 2B.
Figure 4A:
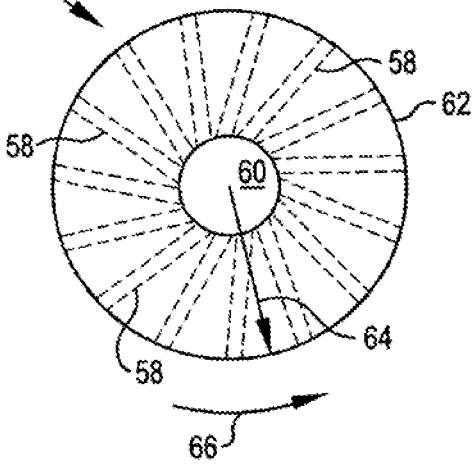
FIG. 4A is a perspective view of a throwing wheel, according to Applicant's co-pending application Ser. No. 10/644,654.
Figure 4B:
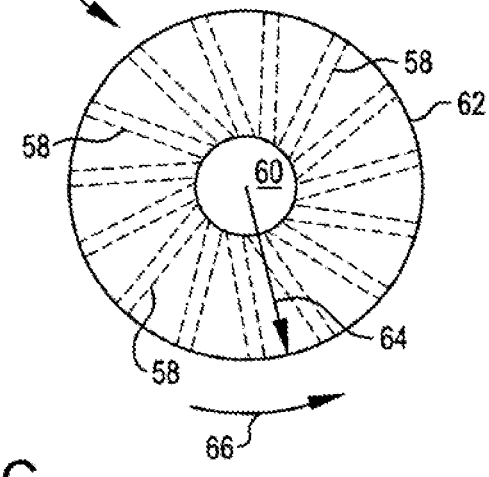
FIG. 4B is a perspective view of another embodiment of a throwing wheel, according to as disclosed in Applicant's co-pending application Ser. No. 10/644,654.
Figure 4C:
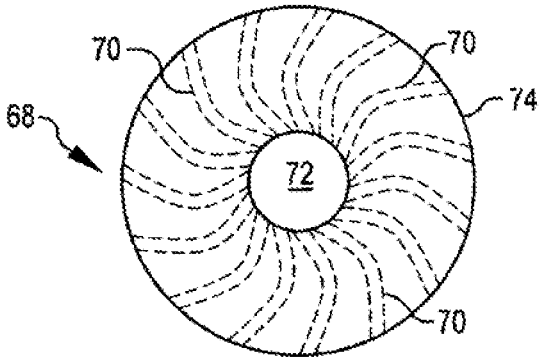
FIG. 4C is a perspective view of another embodiment of a throwing wheel, according to Applicant's co-pending application Ser. No. 10/644,654.
Figure 5:
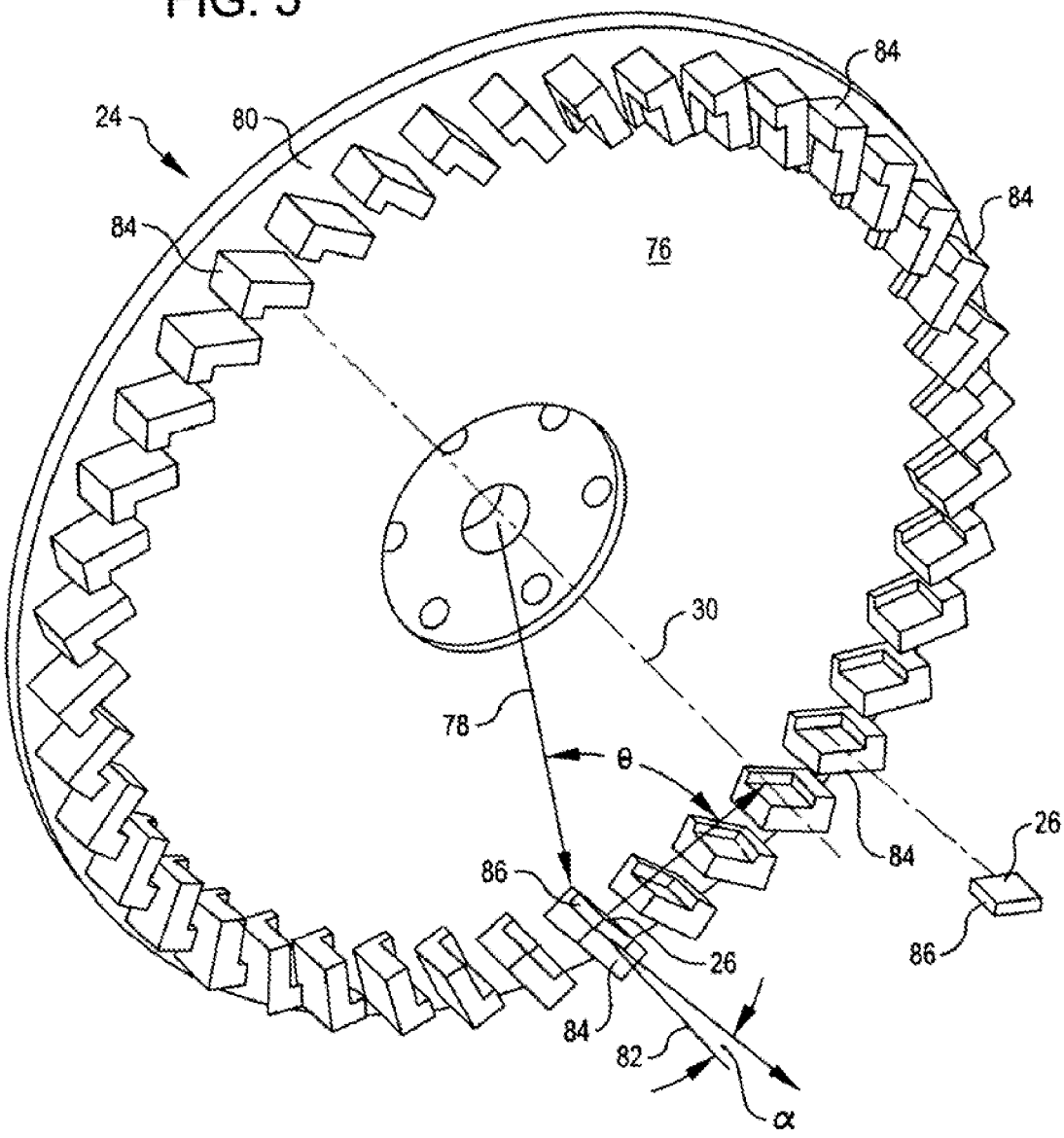
FIG. 5 is a perspective view of the impact rotor in FIGS. 1 and 2A.

As shown in FIG. 3, in one embodiment, the throwing wheel 22 includes channels 44 that extend substantially radially from the hub 42 toward the periphery 54 in a straight or substantially straight direction and intersect the periphery 54 at about 90 degrees to a tangent. Alternate embodiments of the throwing wheel include angled channels 58 which are angled slightly off of a radial, either lagging (FIG. 4A) or leading (FIG. 4B). An example of other embodiments includes arcuate channels 70 of arcuate shape (FIG. 4C).

Figure 6A:
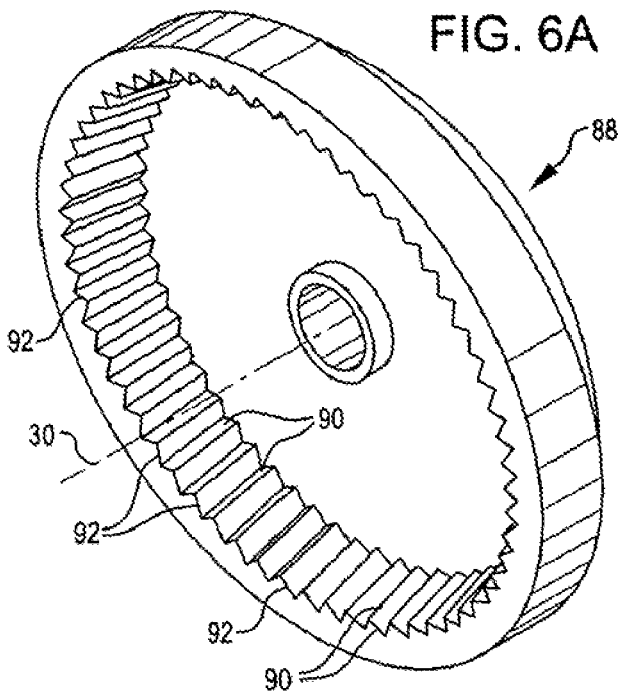
FIG. 6A is a perspective view of another embodiment of an impact rotor, according to Applicant's co-pending application Ser. No. 10/644,654.
Figure 6B:
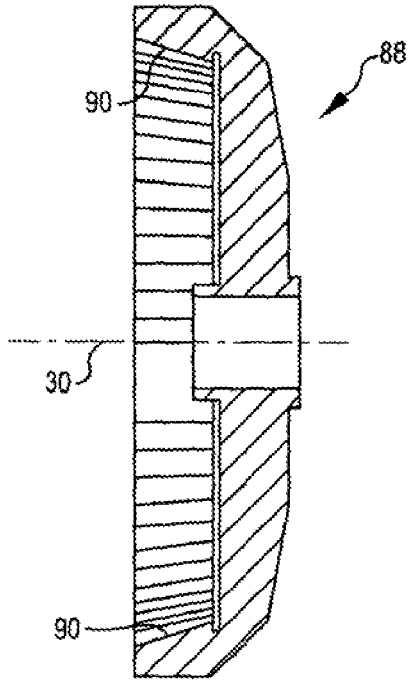
FIG. 6B is a cross-sectional view of the impact rotor in FIG. 6A.

FIGS. 6A and 6B are views of an impact rotor 88, according to another embodiment of the invention. FIG. 6A is a perspective view of another impact rotor 88, and FIG. 6B is a cross-sectional view of the impact rotor 88. The impact rotor 88 is similar to the impact rotor 24 of FIG. 5 except the impact surfaces 90 are angularly positioned such that α (Alpha) is greater than 0°, and a particle of material can not pass between adjacent impact teeth 92. Angularly positioning each impact surface 90 greater than 0° relative to the rotor axis 30 and preventing a particle of material from passing between adjacent impact teeth 92 may be desirable to decrease the number of collisions a particle may have with one or more impact surfaces 90.

Other embodiments are contemplated. For example, each impact surface 90 may be angularly positioned such that α is greater than 0° but canted opposite to the direction shown in FIGS. 6A and 6B. This may be desirable to increase the number of collisions a particle may have with one or more impact surfaces 90.

Figure 7A:
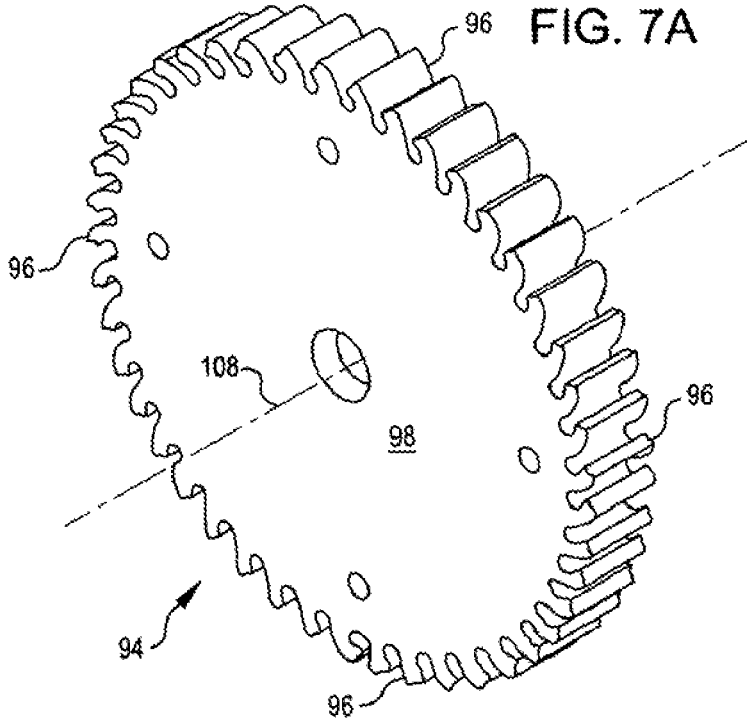
FIG. 7A is a perspective view of another embodiment of an impact rotor, according to Applicant's co-pending application Ser. No. 10/644,654.
Figure 7B:
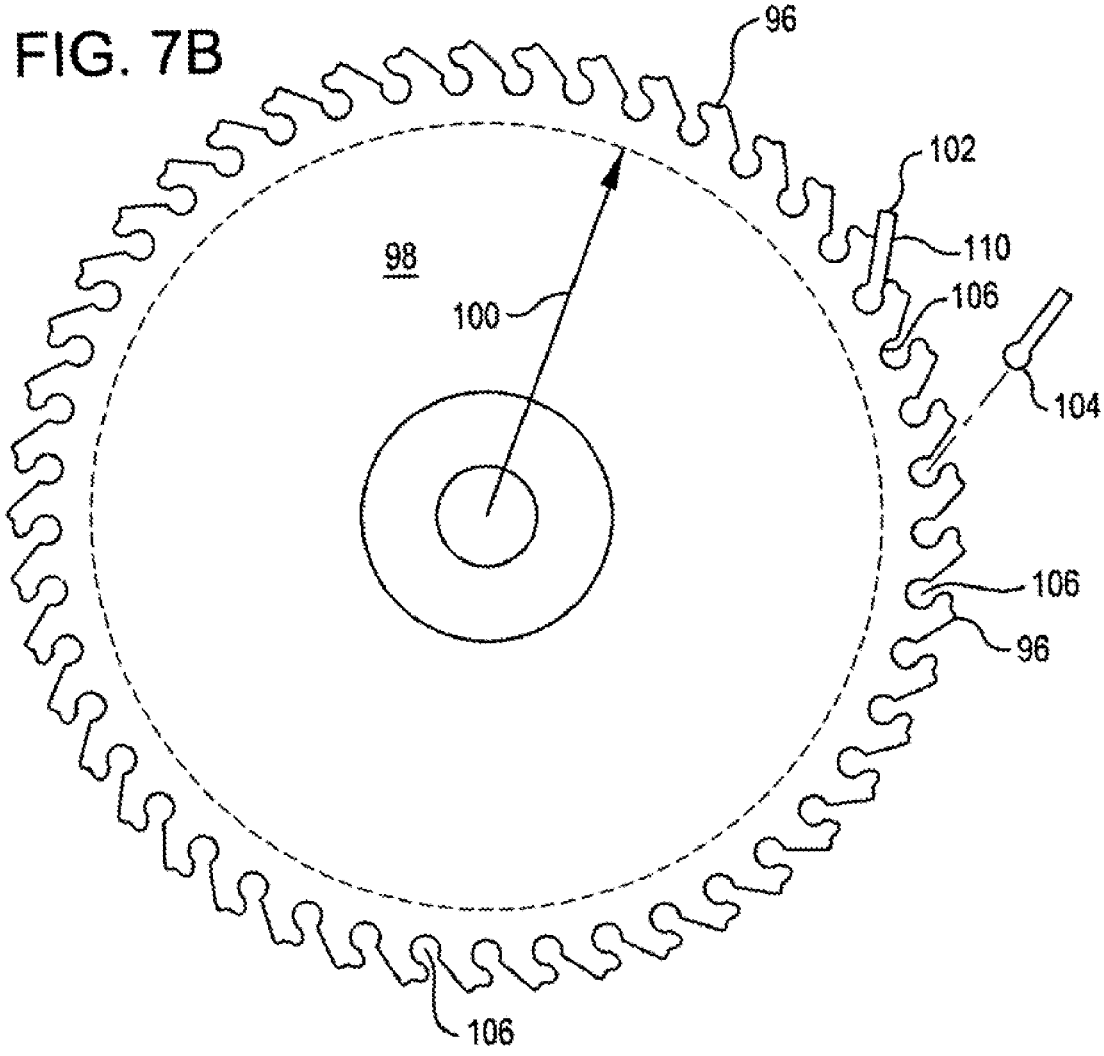
FIG. 7B is a side view of the impact rotor in FIG. 7A.

FIGS. 7A and 7B are views of an impact rotor 94 according to yet another embodiment of the invention. FIG. 7A is a perspective view of the impact rotor 94, and FIG. 7B is a side view of the impact rotor 94. The impact rotor 94 is similar to the impact rotor 24 of FIG. 5 except the impact teeth 96 extend from the body 98 in the same direction as each tooth's respective radius 100. This may be desirable when the impact rotor 94 and throwing wheel 24 (FIG. 3) are not concentric during operation. Each impact plate 102 is mounted on a respective one of the impact teeth 96 by inserting the curved end 104 into a groove 106 and applying adhesive to hold the impact plate 102 to the respective impact tooth 96 in the direction along the rotor axis 108. The impact plate 102 may be mounted such that its impact surface 110 may be facing away from the rotor axis 108 or toward the rotor axis 108, as desired.

Figure 8:
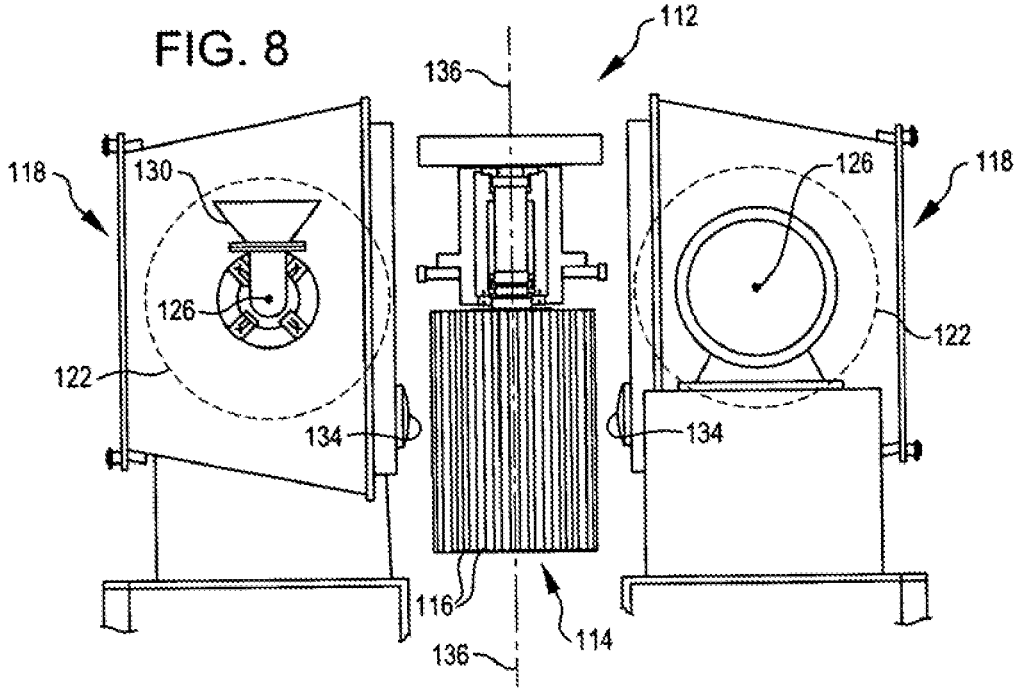
FIG. 8 is a side view of a comminuting device according to Applicant's co-pending application Ser. No. 10/644,654.
Figure 9:
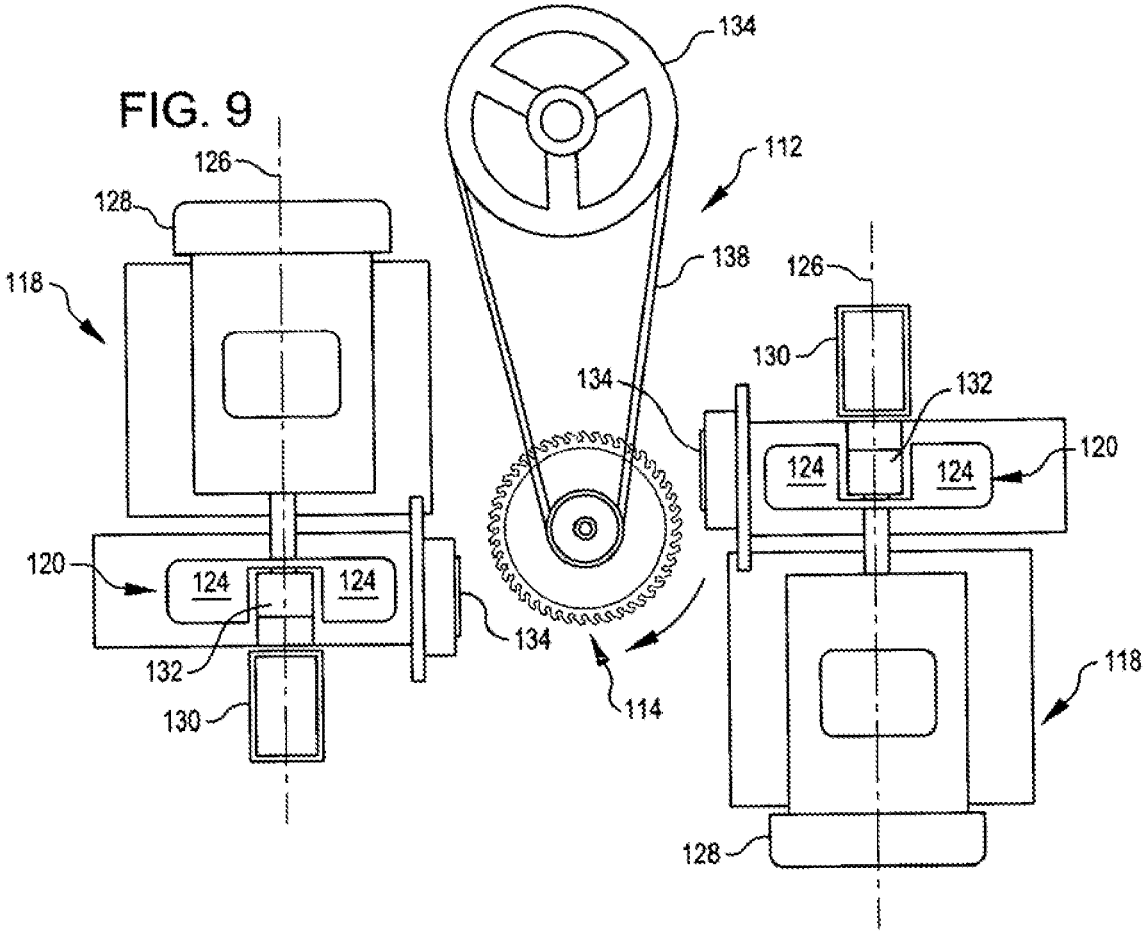
FIG. 9 is a top view of the comminuting device in FIG. 8.

FIGS. 8 and 9 are views of a comminuting device 112 according to another embodiment of the invention. FIG. 8 is a side view of the comminuting device 112, and FIG. 9 is a top view of the comminuting device 112. The comminuting device 112 can efficiently generate impact speeds around 950 ft/sec.

The comminuting device 112 includes an impact rotor 114 that is cylindrical and has impact surfaces 116 to collide with and fracture particles of material, and two particle accelerators 118 to accelerate the particles of material and direct them toward the impact rotor 114. The comminuting device 112 comminutes particles of material by first accelerating the particles with one of the accelerators 118 to an approximate speed of 200-300 ft/sec. Then, the particles are directed toward the impact rotor 114 that rotates to move the impact surfaces 116 at a speed 650 ft/sec or greater toward the particles leaving the accelerators 118. Thus, the comminuting device 112 can generate impact speeds of approximately 850 ft/sec or greater.

In one embodiment, the particle accelerator 118 includes a throwing wheel 120 (shown in FIG. 9 and omitted from FIG. 8 for clarity) having an outer diameter 122 (shown in FIG. 8 and omitted from FIG. 9 for clarity) and blades 124 (shown in FIG. 9 and omitted from FIG. 8 for clarity) that rotate about an axis 126 to accelerate particles of material toward an impact speed, and a motor 128 to rotate the throwing wheel 120. The accelerator 118 also includes a hopper 130 to receive particles of material and feed them to an inlet 132 that is located at the axis 126, and an outlet 134 to direct the particles of material toward the impact rotor 114.

Because the speed of a particle exiting the accelerator 118 largely depends on the throwing wheel's outer diameter 122 and rotational speed, the accelerator 118 may be designed to accelerate particles to any desired exit speed. The exit speed may be substantially determined by multiplying the rotational speed of the throwing wheel 120 times the distance of the particle from the axis 126 (half of the outer diameter 122). Thus, the exit speed may be increased by increasing the throwing wheel's outer diameter 122 and/or rotational speed, and may be decreased by decreasing the throwing wheel's outer diameter 122 and/or rotational speed.

In operation, the accelerator 118 receives particles of material through the hopper 130, which directs the particles toward the inlet 132. Once in the inlet 132, the particles move away from the axis 126 and are picked up and accelerated by a blade 124 of the rotating throwing wheel 120. As the particles' speed increases, centrifugal force moves the particles toward the outer diameter 122 and through progressive regions of the blade 124 whose respective speed increases. Thus, as the particles continue to move toward the outer diameter 122, the blade 124 continues to accelerate the particles toward an impact speed. Then, the outlet 120 receives and directs the particles toward the impact rotor 114.

The impact rotor 114 includes impact surfaces 116 to collide with and fracture the particles of material that have been accelerated by the particle accelerator 118. To increase the impact speed of the particles, a motor 134 (shown in FIG. 9 but omitted in FIG. 8 for clarity) rotates the impact rotor 114 about an axis 136 (shown in FIG. 8 and omitted in FIG. 9 for clarity). A belt 138 couples the motor 134 with the impact rotor 114 to transmit the output power of the motor 134 to the impact rotor 114.

The throwing wheel imparts the initial energy to the particles. It is advantageous both to provide a design which maximizes the energy imparted and retains that design as long as possible despite the erosive environment. Components will wear out and it is advantageous to replace them in an expeditious manner.

FURTHER EMBODIMENTS

With reference to FIGS. 10-20, further embodiments are presented which improve one or more of comminution efficiency, endurance and maintainability.

As shown in FIGS. 10, 11 and 12, an improved comminuting apparatus 200 includes another embodiment of a throwing wheel 202 having improved construction and material flow characteristics. The throwing wheel 202 enables use of particularly wear-resistant components only where required. Flow channels 204 through the throwing wheel 202 are provided which minimize energy loss for maximum acceleration of the materials. The throwing wheel 202 is rotatably driven with a drive shaft and motor arrangement 206. The arrangement 206 is secured to the throwing wheel 202 with an erosion-avoidant arrangement. An impact rotor 208 is similarly rotatably driven with a drive shaft and motor arrangement 210 which is secured to the impact rotor 208 with an erosion-avoidant arrangement.

Preferably the impact rotor 208 is contra-rotating to the throwing wheel 202. Not detailed for this embodiment, however as described above in the co-pending application, a first motor is directly coupled to the impact rotor and operable to power the impact rotor and a second motor directly coupled to the throwing wheel and operable to power the throwing wheel.

Further, the comminuting apparatus further comprises an embodiment of a housing 212 which is readily accessible for maintenance, particularly the throwing wheel 202 and impact rotor 208. The housing 212 comprises an upper housing 213 and a lower housing 214 which are reversibly and axially separable for accessing a comminuting chamber 215 and for accessing the throwing wheel 202 and impact rotor 208 operable within the chamber 215.

The upper housing 213 is supported in space by stands 216. The lower housing 214 is suspended from the upper housing 213 by actuators 218. Actuators 218 are operated for raising and lowering the lower housing 214 relative to the upper housing 213 between a raised operating position (FIG. 10) and a lowered maintenance position (FIG. 12) for enabling access to the throwing wheel 202 and impact rotor 208. The upper and lower housings 213,214 seal at an interface 220 in the raised operating position and position the throwing wheel 202 and impact rotor 208 in co-axial operably-spaced arrangement. As shown in the top view of the housing 212 in FIG. 11, there can be multiple supports 216, equi-spaced circumferentially about the upper housing 213, three supports 216,216,216 being shown spaced about 120° apart with three actuators 218 circumferentially spaced therebetween.

With reference to FIG. 13, the impact rotor 208 and throwing wheel 202 rotate about a substantially and concentric, vertical axis A. In one embodiment, as shown, the impact rotor 208 is arranged co-axially above the throwing wheel 202. In this arrangement, particulate materials M or particles to be comminuted pass through the axis A of the impact rotor 208 to access the throwing wheel 202. In a mirror arrangement (not shown) wherein the throwing wheel 202 is above the impact rotor 208, the particles M can fall along the axis A of the throwing wheel directly. Terms such as bottom and top are used herein in the illustrated context of the impact rotor 208 arranged over the throwing wheel 202.

The impact rotor 208 and throwing wheel 202 is an assembly of a body 222 and a plurality of impact teeth 223 spaced about the periphery of the body 222 and extending axially therefrom. The throwing wheel 202 can be an assembly of a bottom plate 212, a top plate 213 and a plurality of inserts 226 sandwiched therebetween. The inserts 226 determine the configuration of the channels 204 formed therebetween. As discussed later the inserts can be pie-shaped for forming channels 204 of substantially parallel side walls. The plurality of channels 204 extend from a central inlet 227 to a plurality of particle exits 229. An apex 228 of each insert 226 is oriented generally radially inwardly towards the axis A.

In more detail in FIGS. 14A and 14B, impact rotor 208 shown above the throwing wheel 202 comprises a plurality of teeth 223 extending downwardly therefrom and mechanically fastened to body 222 for ease of replacement. A central hole 230 in the body 222 passes particles M to the throwing wheel 202 co-axially arranged therebelow. One embodiment of each tooth 223 is a triangular form, providing one or more impact surfaces 231 which can be oriented for optimal impact with particles thrown from the throwing wheel 202. Each tooth 223 can be secured with a single fastener 215 enabling rotation positioning of the impact surfaces 231.

The throwing wheel 202 is a sandwiched assembly 225, 226,224 for ease of replacing wear components. The inserts 226 are spaced circumferentially about the wheel 202 and spaced from one another for forming energy imparting side walls of the generally radially extending channels 204. As described in Applicant's co-pending application, a variety of channel configurations are contemplated. A further configuration is described herein.

As shown in FIGS. 15C and 15D, the bottom plate 224 comprises a mounting means for securing the inserts 226 in a position for forming the channels 204. In this embodiment, the mounting means comprise a plurality of axially extending bosses 240 which form mounting and positioning structure for the inserts 226 (see FIG. 15E). Each boss 240 corresponds to a cavity or socket 241 formed in each insert 226. The bosses 240 extend axially from at least one of the top or bottom plates 225,224. As shown, the bosses 240 can be formed integrally with the bottom plate 224 or otherwise secured thereto. The bosses 240 need not be designed for wear-resistance as each insert 226 encapsulates the boss 221.

Each insert 226 has a leading side wall 250 and a lagging side wall 251. Between the leading side wall 250 and lagging side wall 251 of adjacent inserts is formed each channel 204. The bottom plate 224 and top plate 225 form the bottom and top of the channel 204 respectively. As shown in FIGS. 13, 15A and 15B, particles M can enter the throwing wheel 202 through the central inlet port 227 formed in the top plate 225. The leading and lagging side walls 250,251 can be parallel or non-parallel.

As discussed above, the channels 204 guide the particles M and urge them along a vector including a tangential component, applying significant wear on the side walls 250,251 of the channels 204. Implementation of this arrangement of replaceable inserts 226 enables selection of differing, greater wear-resistant materials for the side walls 250,251 than those used for the top and bottom plates 225,224.

With reference to FIGS. 15E and 15F, each insert 226 has cavities or sockets 241, each of which corresponds in shape to each boss 240. A plurality of inserts 226 are shown in FIG. 15E arranged for superpositioning their respective sockets 241 over each insert's corresponding boss 240, a subset of the fourteen illustrated inserts 226 being shown installed over a respective subset of bosses 240 of FIG. 15F. As shown, one form of corresponding boss 240 and socket 241 include a pie or triangular shape which both orients each triangular insert 226 and fixes its position in the throwing wheel 202. The apex 228 of each pie-shaped insert 226 is oriented generally radially inwardly towards the central inlet port 227. Other boss 240 and socket 241 combinations are contemplated within the scope of this application.

With reference to FIG. 16, an assembled impact rotor 208 is shown poised over an exploded-view of the throwing wheel 202 and demonstrating installation of inserts 226 to bosses 240 for assembly of the throwing wheel 202. With reference also to FIG. 15E, one can see the inserts 226 right of the illustrated centerline have been fit to the rightmost bosses 240 and the remaining inserts 226 left of the centerline are ready for fitting to the remaining bosses 240. Means for fastening the sandwiched assembly are contemplated, including pairs of counter-sunk base holes 243 through the bottom plate 224 at each boss 240 for fasteners to secure to top holes 244 in the top plate 225, the fasteners being omitted from the view.

In some more detail, the top plate 225 is secured to the bottom plate 224 using fasteners which extend through the bosses 240 and inserts 226, securely mounting the inserts 226 against the inertial forces generated while rotating and accelerating particles. The material properties of the insert 226 can be selected dependent upon the particles being processed including metallic alloys, hardfaced materials and ceramics. The materials choices for the top plate 225, bottom plate 224 and bosses 240 are less subject to erosion and can be based more so upon mechanical assembly principles and need not be restricted to wear-resistance.

The side walls 250,251 of the inserts 226 direct and accelerate the particles in a curved radial path in global coordinates and thus are subjected to maximal forces and erosion as they impart acceleration forces in redirecting the particles M. The bottom and top of the channels 204 are not directly involved in redirecting particles except to the extent that they constrain gravity, random movement and some circulation. Accordingly, adaptation of the materials or surface of the top and bottom plates for wear resistance can less critical. The impact surfaces 231 of the impact rotor 208 are also designed for, and subjected to, near instantaneous deceleration of the particles thrown from the wheel 202 and thus are also subject to extreme erosive forces. The teeth 223 themselves can form the impact surface 231 and accordingly be formed of wear-resistant materials or, as described in the co-pending application Ser. No. 10/644,654, separate wear-resistance impact surfaces 231 can be fit to each tooth 223.

Another area of direct particulate erosion occurs when the particles from the hopper impinge on the bottom plate 224 through the central port 227 through the top plate 225. The trajectory of the particles from the hopper are redirected from a substantially vertically downward flow along the axis A to a radial flow through the channels 204. This redirection results in wear. A substantially planer surface 245 on the bottom plate 224 has been employed successfully. This is an area which could be protected by an anti-wear treatment. In embodiments having the throwing wheel mounted to the drive through the bottom plate 224, the planer surface 245 is not penetrated by any mounting hardware and the planer surface 245 can be fit with ceramics or elastomeric materials without compromising the integrity of either the wear surface or the throwing wheel.

With reference to FIG. 19, the channels 204, the impact surface 231 and to a lesser extent the central port 227 in the wheel 202, are not the only components subject to wear. A circulation of comminuted particles adjacent the impact rotor at the impact surfaces 231, and between the generally planer contra-rotating surfaces of the impact rotor 208 and the throwing wheel 202 is also a known erosive factor. These planer surface are not subjected to the same energy of impact and other anti-wear solutions are available, in structure and in material choices. Accordingly, in another aspect of the invention, an area of consideration for protection is the planer underside 261 of the impact rotor 208 which faces a top surface 262 of the top plate 225. There is necessarily a gap 263 therebetween for enabling contra-rotation of the components.

This gap 263 is not a processing path for comminuting particles however, due to the inherent distribution of comminuted dust throughout the housing 212, some particles circulate into and out of the his gap 263, causing wear. As the exposed surfaces in the gap 263 are not energy transferring surfaces, such as the hard materials of the inserts 226 and impact surfaces 231, one can install wear-resistant, resilient, elastomeric materials such as urethane to one or the other of the impact rotor or the throwing wheel facing the gap 263. For example, it has been noted that wear has been more predominant on the underside 261 of the impact rotor 208. Accordingly an anti-wear surface or protective layer 265, such as an elastomeric material including urethane, is employed along the rotor's underside 261.

Further, the gap 263 extends radially to a peripheral interface between the throwing wheel 202 and the impact teeth 231, is formed an annular impact area 270. Above the impact areas 270, the underside 261 is also subject to wear and is preferably also coated with a protective layer 265. In addition, the life of the impact rotor 208 can be extended by mounting the impact teeth 231 on an optional annular ring 271 which is easily replaced when worn.

Turning to the performance of the particle movement, and as shown in FIGS. 17 and 18, the flow characteristics of the multiphase flow of particles or material through air is modeled to demonstrate the effectiveness of the channel design 204.

Surprisingly, the use of parallel side walls 250,251 for the channel 204, while functional, is not necessarily optimal. FIGS. 17 and 18 illustrate particle velocity results of Computational Fluid Dynamics (CFD) analysis. The reference for the velocity vectors is relative to the throwing wheel. The velocity vectors are those viewed from the throwing wheel as it rotates. As shown in FIG. 18, where side by side inserts 226,226 form a parallel; wall channel 204*p* therebetween, The flow mechanics can result in eddies E, illustrating some areas of substantially stationary particles, which result in a loss of some of the energy capable of being imparted to the particles. As shown in FIG. 17, where the side by side inserts 226,226 form a converging wall channels 204*c* therebetween. The particles in the converging channel 204*c* achieve near or substantially streamline flow. Modeling programs such as ANSYS® can be used to ascertain the proper convergence for optimal flow characteristics to avoid eddies.

One example of a suitable convergence is as shown in FIG. 15F, the angle of each insert's side wall 250,251 to a radial from the axis A of the throwing wheel 202 being about 5° or an included angle of about 9-10° between the side walls 250,251 of adjacent inserts 226,226. The modeling was based upon particles diameters 3 mm, wheel rotational speed of 3,000 RPM and channel dimensions of 25 mm×15 mm. One approach to determination of channel convergence is to reduce the cross-section area as the flow accelerates to minimize flow separation and eddy currents. Another approach is to establish the convergence angle based upon achieving a channel exit cross section area times the radius of the approximately equal to the channel inlet cross section area times the inlet radius.

In operation, the throwing wheel 202 is rotated about the substantially vertical axis A. Particles to be fragmented through the central inlet 227 for accelerating the particles through the channels 204. The particles accelerated generally radially along a converging flow path in the channels 204 as the particles flow from the central inlet 227 to the particle exits for favoring streamline flow of particles between the side walls 250,251. The particles discharge from the particle exits 229 and impact against impact surfaces 231 arranged about the periphery of the throwing wheel 202. Preferably the impact rotor 208 is rotated co-axial with the throwing wheel 202 and the impact rotor 208 is counter-rotated relative to the throwing wheel 202.

With reference to FIG. 20, another embodiment of the invention concerns product and dust management. The housing 212 is fit with atmospheric flow controls for minimizing re-entrainment of product and dusts into the area about the throwing wheel 202 and impact rotor 208.

As shown, the upper housing 213 is fit with a tubular skirt 300 extending axially downward into close proximity with the wheel/rotor assembly 301 of the comminuting apparatus 200. Similarly, lower housing 214 is fit with a tubular skirt 302 extending axially upward into close proximity with the wheel/rotor assembly 301. Within skirts 300 and 302 are formed exclusion chambers 303 which can be swept with a flow of clean gas such as air. Air fittings 304 can direct air into the exclusion chambers 303,303 for flow out of the chambers adjacent the wheel/rotor assembly 301 for excluding particular material therefrom. Dust extraction from the comminuting chamber 215 can be through dust ports 305. Comminuted material product exits the comminuting chamber 215 via a lower exit 306.

The invention claimed is:

1. Apparatus for fragmenting particles comprising:

a throwing wheel comprising a body having a central inlet port along an axis of the body and a periphery having a plurality of particle exits, the port being adapted for receiving particles, and a plurality of channels within the body extending generally radially from the central inlet port to the plurality of particle exits, each channel having a top wall, a bottom wall, and side walls, wherein the side walls of each channel converge towards the particle exits at the periphery, and wherein the throwing wheel is rotatable in a first direction and operable to receive the particles for accelerating and directing the particles from a periphery of the throwing wheel along a particle trajectory;

an impact rotor having a peripheral impact surface positioned concentrically about the throwing wheel for intersecting the particle trajectory;

the impact rotor rotatable in a second direction opposite to the throwing wheel for increasing an impact speed of the particles and fragmenting the particles when the particles collide with the impact surface;

a first motor directly coupled to the impact rotor and operable to power the impact rotor; and a second motor directly coupled to the throwing wheel and operable to power the throwing wheel.

2. The throwing wheel of claim 1 wherein the body further comprises:

a top plate;

a bottom plate; and a plurality of inserts sandwiched between the top plate and the bottom plate for mounting the inserts in a circumferentially spaced position, each insert having a leading side wall and a lagging side wall, the leading side wall and lagging side wall of adjacent inserts forming the side walls of each channel.

3. The throwing wheel of claim 2 wherein the material of the inserts has a greater wear resistance than that of the top and bottom plates.

4. The throwing wheel of claim 2 wherein the inserts are pie-shaped, each having an apex oriented generally radially inwardly towards the central port.

5. The throwing wheel of claim 2 further comprising:

a plurality of bosses axially extending from at least one of the top plate or bottom plate, and wherein the inserts have an axially extending cavity formed between the leading and lagging side walls, and wherein the cavity of each insert engages each axially extending boss as the top plate and bottom plate sandwiches the plurality of inserts therebetween.

6. The throwing wheel of claim 5 wherein each boss is generally pie-shaped, and the cavity in each insert is generally pie-shaped.

7. The throwing wheel of claim 5 wherein at least some of the bosses are axially extending from the bottom plate.

8. The throwing wheel of claim 7 wherein the bosses are integral with the bottom plate.

9. The throwing wheel of claim 2 further comprising a plurality of fasteners extending between the top plate and the bottom plate for sandwiching the plurality of inserts therebetween.

10. The throwing wheel of claim 2 wherein the side walls of each channel converge towards the particle exits at the periphery.

11. The throwing wheel of claim 1 wherein a gap is formed between the throwing wheel and the impact rotor further comprising an elastomeric anti-wear surface applied to at least one of the impact rotor or throwing wheel facing the gap.

12. The apparatus of claim 1 further comprising a housing within which the throwing wheel and impact rotor are housed.

13. The apparatus of claim 12 wherein the housing further comprises:

an upper housing for rotatably supporting one of the throwing wheel or impact rotor; and a lower housing for rotatably supporting the other of one of the impact rotor or throwing wheel, the upper and lower housings being separable at about the throwing wheel for access to the throwing wheel and impact rotor.

14. The apparatus of claim 13 further comprising:

a housing support for maintain the upper housing in a substantially fixed position; and an actuator for moving the lower housing between a closed position wherein the throwing wheel and impact rotor are axially coupled for aligning the particle trajectory with the impact surface, and an open position wherein the throwing wheel and impact rotor are axially decoupled for access to each throwing wheel and impact rotor in dependently.

15. The apparatus of claim 14 wherein the actuator further comprises one or more actuators positioned between the upper housing and the lower housing.

16. The apparatus of claim 15 wherein the one or more actuators further comprise two or more actuators, circumferentially spaced about a periphery of the upper housing and extending axially between the upper housing and the lower housing.

17. The apparatus of claim 16 wherein the one or more actuators further comprise three actuators equally spaced about a periphery of the upper housing.

18. The apparatus of claim 14 wherein the housing support further comprises one or more supports positioned between the upper housing and a surface.

19. The apparatus of claim 18 wherein the one or more supports further comprise three supports equally spaced about a periphery of the upper housing.

* * * * *